US009176448B2

(12) United States Patent
Kobayashi

(10) Patent No.: US 9,176,448 B2
(45) Date of Patent: Nov. 3, 2015

(54) IMAGE FORMING APPARATUS CAPABLE OF ADJUSTING BLACK AND COLOR PRINT DENSITIES AND CONTROL PROGRAM FOR ADJUSTING SUCH DENSITIES

(71) Applicant: Oki Data Corporation, Tokyo (JP)

(72) Inventor: Yasushi Kobayashi, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 14/314,350

(22) Filed: Jun. 25, 2014

(65) Prior Publication Data

US 2015/0003855 A1 Jan. 1, 2015

(30) Foreign Application Priority Data

Jun. 28, 2013 (JP) ..... 2013-136915

(51) Int. Cl.
*G03G 15/00* (2006.01)

(52) U.S. Cl.
CPC .... *G03G 15/5058* (2013.01); *G03G 2215/0141* (2013.01); *G03G 2215/0164* (2013.01)

(58) Field of Classification Search
CPC ..... G03G 15/556; G03G 15/5058; G03G 2215/0141; G03G 2215/0164; G03G 15/5016
USPC ..... 399/72, 81, 138
See application file for complete search history.

(56) References Cited

U.S. PATENT DOCUMENTS 4,294,536 A * 10/1981 Paxton ..... 399/138
4,310,237 A * 1/1982 Gengelbach ..... 399/138
4,350,435 A * 9/1982 Fiske et al. ..... 399/138
4,627,713 A * 12/1986 Abuyama ..... 399/52
5,377,013 A * 12/1994 Oka et al. ..... 358/501
5,424,754 A * 6/1995 Bar et al. ..... 345/549
5,655,185 A * 8/1997 Hori et al. ..... 399/138
5,717,838 A * 2/1998 LeClair ..... 358/1.9
5,917,511 A * 6/1999 Ueda ..... 347/19
5,999,175 A * 12/1999 Nalder ..... 715/766

(Continued)

FOREIGN PATENT DOCUMENTS

JP 10-322564 A 12/1998
JP 2002-082511 A 3/2002
JP 2006-076012 A 3/2006

OTHER PUBLICATIONS

Machine translation of JP 2002082511 A.*

*Primary Examiner* — David Bolduc
(74) *Attorney, Agent, or Firm* — Muncy, Geissler, Olds & Lowe, P.C.

(57) ABSTRACT

An image forming apparatus includes a sample pattern outputting part holding a sample pattern and supplying the held sample pattern to the image forming part, a selection part allowing a user to select one of the color sample images that configure the sample pattern, an image formation density adjustment amount holding part determining and holding image formation density adjustment amounts for increasing or decreasing image formation densities of the plurality of the colors, an image formation density adjusting part adjusting image formation densities of the plurality of the colors according to the image formation density adjustment amounts, a presenting part presenting to the user the image formation density adjustment amounts; and an image formation density adjustment amount modifying part receiving from the user modifications with respect to the image formation density adjustment amounts and updating the image formation density adjustment amounts.

6 Claims, 28 Drawing Sheets

(56) References Cited

U.S. PATENT DOCUMENTS

| | | | | |
|---|---|---|---|---|
| 6,535,307 | B1 * | 3/2003 | Allen et al. | 358/504 |
| 6,606,167 | B1 * | 8/2003 | Rees et al. | 358/1.9 |
| 7,187,884 | B2 * | 3/2007 | Bardolatzy et al. | 399/81 |
| 2003/0081274 | A1 * | 5/2003 | Yamamoto | 358/504 |
| 2005/0058476 | A1 * | 3/2005 | Murakami | 399/366 |
| 2005/0219634 | A1 * | 10/2005 | Murakami | 358/3.28 |
| 2006/0051108 | A1 * | 3/2006 | Kobayashi | 399/12 |
| 2008/0310873 | A1 * | 12/2008 | Ono | 399/74 |
| 2010/0177367 | A1 * | 7/2010 | Komatsu et al. | 358/518 |
| 2010/0215392 | A1 * | 8/2010 | Shiraki et al. | 399/72 |

* cited by examiner

: Target Image

: Reference Image

: Color Sample Image

*Fig. 7*

| | | Column Number | | | |
|---|---|---|---|---|---|
| | | 1 | 2 | 3 | 4 |
| Row Number | 1 | (102, 102, 102, 0) | | | |
| | 2 | ( 92, 102, 102, 0) | ( 97, 102, 102, 0) | (102, 107, 107, 0) | (102, 112, 112, 0) |
| | 3 | ( 92, 92, 102, 0) | ( 97, 97, 102, 0) | (102, 102, 107, 0) | (102, 102, 112, 0) |
| | 4 | (102, 92, 102, 0) | (102, 97, 102, 0) | (107, 102, 107, 0) | (112, 102, 112, 0) |
| | 5 | (102, 92, 92, 0) | (102, 97, 97, 0) | (107, 102, 102, 0) | (112, 102, 102, 0) |
| | 6 | (102, 102, 92, 0) | (102, 102, 97, 0) | (107, 107, 102, 0) | (112, 112, 102, 0) |
| | 7 | ( 92, 102, 92, 0) | ( 97, 102, 97, 0) | (102, 107, 102, 0) | (102, 112, 102, 0) |

*Fig. 8*

Please Specify Number of Image That Appears To Be Most Achromatic In Color Adjustment Sheet Row Number: 2

Column Number: 4

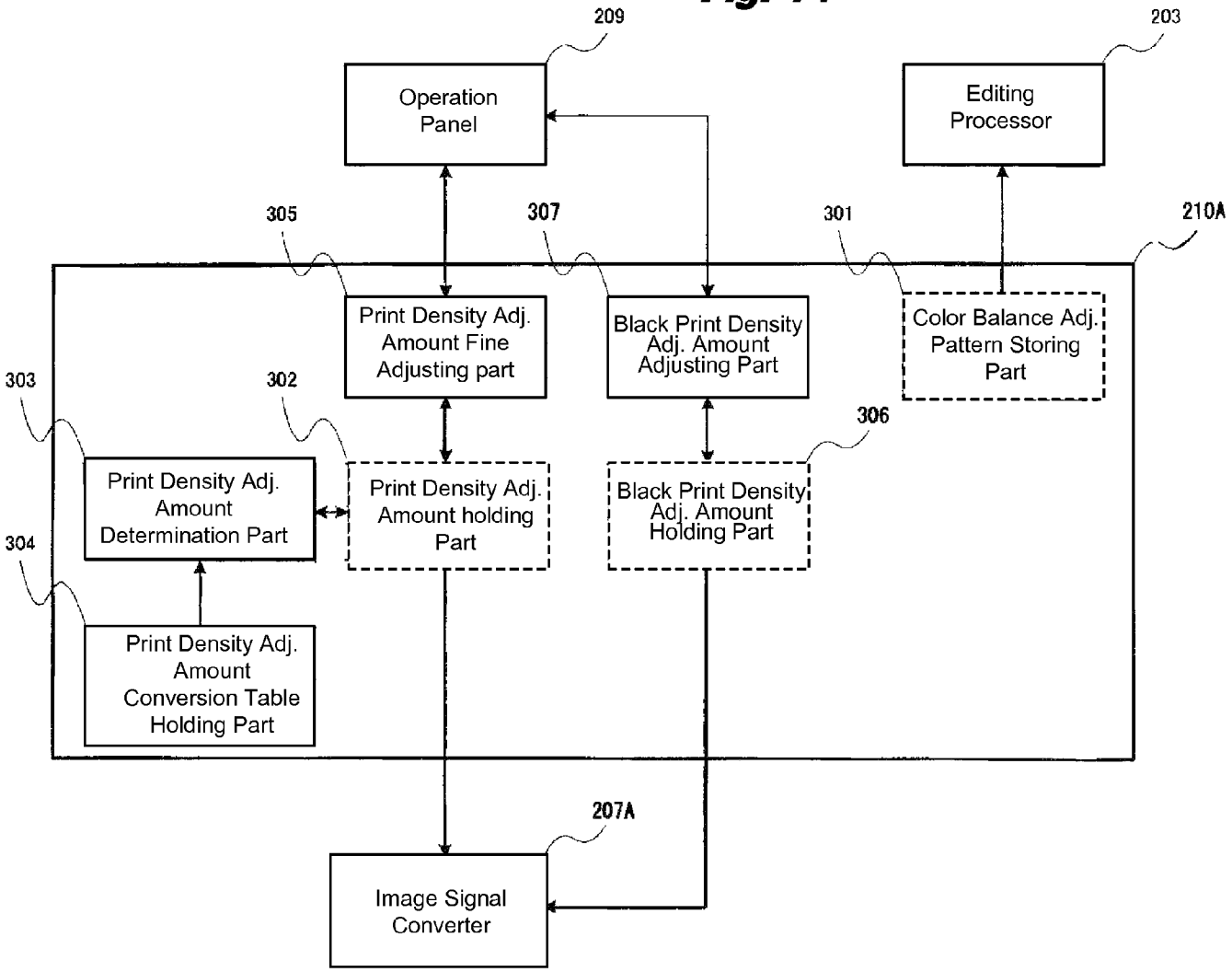
Fig. 14
203
Editing Processor
210A
Color Balance Adj. Pattern Storing Part
301
306
Black Print Density Adj. Amount Adjusting Part
Black Print Density Adj. Amount Holding Part
209
Operation Panel
307
207A
Print Density Adj. Amount Fine Adjusting part
Print Density Adj. Amount holding Part
Image Signal Converter
305
302
Print Density Adj. Amount Determination Part
Print Density Adj. Amount Conversion Table Holding Part
303
304

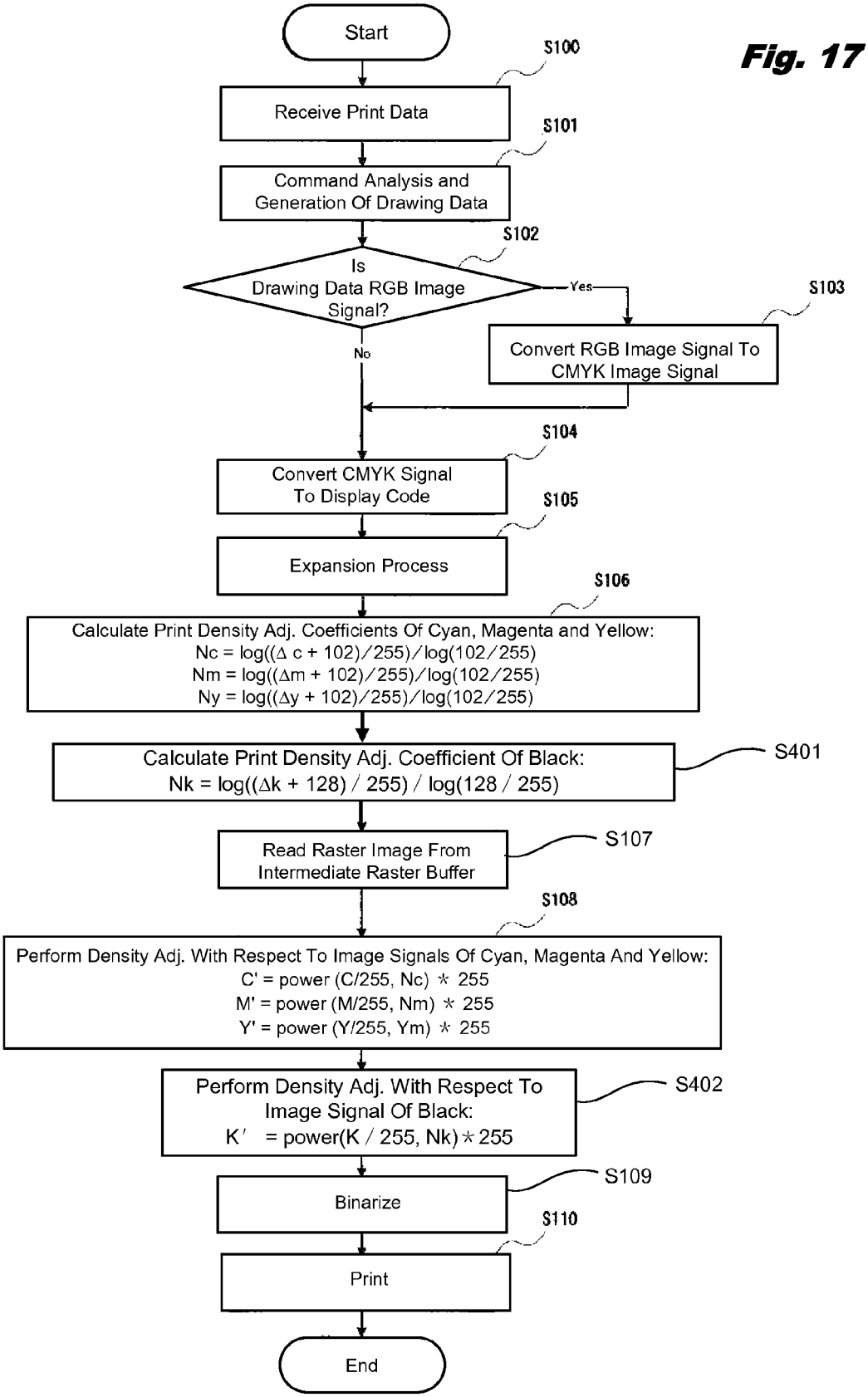
Fig. 17
Start
S100
Receive Print Data
S101
Command Analysis and Generation Of Drawing Data
S102
Is Drawing Data RGB Image Signal?
Yes
No
S103
Convert RGB Image Signal To CMYK Image Signal
S104
Convert CMYK Signal To Display Code
S105
Expansion Process
S106
Calculate Print Density Adj. Coefficients Of Cyan, Magenta and Yellow:
Nc = log((Δ c + 102)/255)/log(102/255)
Nm = log((Δm + 102)/255)/log(102/255)
Ny = log((Δy + 102)/255)/log(102/255)
S401
Calculate Print Density Adj. Coefficient Of Black:
Nk = log((Δk + 128) / 255) / log(128 / 255)
S107
Read Raster Image From Intermediate Raster Buffer
S108
Perform Density Adj. With Respect To Image Signals Of Cyan, Magenta And Yellow:
C' = power (C/255, Nc) * 255
M' = power (M/255, Nm) * 255
Y' = power (Y/255, Ym) * 255
S402
Perform Density Adj. With Respect To Image Signal Of Black:
K′ = power(K / 255, Nk) * 255
S109
Binarize
S110
Print
End

Fig. 21A

Low Density Region

| Row Number | Column Number 1 | 2 | 3 | 4 |
|---|---|---|---|---|
| 1 | (51, 51, 51, 0) | | | |
| 2 | (41, 51, 51, 0) | (46, 51, 51, 0) | (51, 56, 56, 0) | (51, 61, 61, 0) |
| 3 | (41, 41, 51, 0) | (46, 46, 51, 0) | (51, 51, 56, 0) | (51, 51, 61, 0) |
| 4 | (51, 41, 51, 0) | (51, 46, 51, 0) | (56, 51, 56, 0) | (61, 51, 61, 0) |
| 5 | (51, 41, 41, 0) | (51, 46, 46, 0) | (56, 51, 51, 0) | (61, 51, 51, 0) |
| 6 | (51, 51, 41, 0) | (51, 51, 46, 0) | (56, 56, 51, 0) | (61, 61, 51, 0) |
| 7 | (41, 51, 41, 0) | (46, 51, 46, 0) | (51, 56, 51, 0) | (51, 61, 51, 0) |

Fig. 21B

Intermediate Density Region

| Row Number | Column Number 1 | 2 | 3 | 4 |
|---|---|---|---|---|
| 1 | (102, 102, 102, 0) | | | |
| 2 | ( 92, 102, 102, 0) | ( 97, 102, 102, 0) | (102, 107, 107, 0) | (102, 112, 112, 0) |
| 3 | ( 92, 92, 102, 0) | ( 97, 97, 102, 0) | (102, 102, 107, 0) | (102, 102, 112, 0) |
| 4 | (102, 92, 102, 0) | (102, 97, 102, 0) | (107, 102, 107, 0) | (112, 102, 112, 0) |
| 5 | (102, 92, 92, 0) | (102, 97, 97, 0) | (107, 102, 102, 0) | (112, 102, 102, 0) |
| 6 | (102, 102, 92, 0) | (102, 102, 97, 0) | (107, 107, 102, 0) | (112, 112, 102, 0) |
| 7 | ( 92, 102, 92, 0) | ( 97, 102, 97, 0) | (102, 107, 102, 0) | (102, 112, 102, 0) |

Fig. 21C

High Density Region

| Row Number | Column Number 1 | 2 | 3 | 4 |
|---|---|---|---|---|
| 1 | (153, 153, 153, 0) | | | |
| 2 | (143, 153, 153, 0) | (148, 153, 153, 0) | (153, 158, 158, 0) | (153, 163, 163, 0) |
| 3 | (143, 143, 153, 0) | (148, 148, 153, 0) | (153, 153, 158, 0) | (153, 153, 163, 0) |
| 4 | (153, 143, 153, 0) | (153, 148, 153, 0) | (158, 153, 158, 0) | (163, 153, 163, 0) |
| 5 | (153, 143, 143, 0) | (153, 148, 148, 0) | (158, 153, 153, 0) | (163, 153, 153, 0) |
| 6 | (153, 153, 143, 0) | (153, 153, 148, 0) | (158, 158, 153, 0) | (163, 163, 153, 0) |
| 7 | (143, 153, 143, 0) | (148, 153, 148, 0) | (153, 158, 153, 0) | (153, 163, 153, 0) |

Fig. 22

Please Specify Number of Image That Appears To Be Most Achromatic In Color Adjustment Sheet

| | Row Number | Column Number |
|---|---|---|
| Low D.R.* | 5 | 1 |
| Intermediate D.R.* | 2 | 4 |
| High D.R.* | 3 | 3 |

*D.R. : density region

Fig. 23

Print Density Fine Adjustment

| | Cyan | Magenta | Yellow |
|---|---|---|---|
| Low D.R.* | | | |
| Intermediate D.R.* | | | |
| High D.R.* | | | |

*D.R. : density region

Fig. 24A

Print Density Fine Adjustment

| | Cyan | Magenta | Yellow |
|---|---|---|---|
| Low D.R.* | −5 | +10 | +5 |
| Intermediate D.R.* | +5 | −10 | −5 |
| High D.R.* | −5 | +10 | +5 |

*D.R. : density region

Fig. 24B

Print Density Fine Adjustment

| | Cyan | Magenta | Yellow |
|---|---|---|---|
| Low D.R.* | −5 | −2 | −6 |
| Intermediate D.R.* | +5 | +4 | +7 |
| High D.R.* | −5 | +10 | +10 |

*D.R. : density region

Fig. 24C

Print Density Fine Adjustment

| | Cyan | Magenta | Yellow |
|---|---|---|---|
| Low D.R.* | −2 | −2 | −6 |
| Intermediate D.R.* | +8 | +4 | +7 |
| High D.R.* | −2 | +10 | +10 |

*D.R. : density region

Fig. 29

Black Print Density Adjustment

| | Black |
|---|---|
| Low D.R.* | |
| Intermediate D.R.* | |
| High D.R.* | |

*D.R. : density region

Fig. 30A

| | Black |
|---|---|
| Low D.R.* | 0 |
| Intermediate D.R.* | 0 |
| High D.R.* | 0 |

*D.R. : density region

Fig. 30B

| | Black |
|---|---|
| Low D.R.* | −5 |
| Intermediate D.R.* | +5 |
| High D.R.* | −5 |

*D.R. : density region

IMAGE FORMING APPARATUS CAPABLE OF ADJUSTING BLACK AND COLOR PRINT DENSITIES AND CONTROL PROGRAM FOR ADJUSTING SUCH DENSITIES

CROSS REFERENCE TO RELATED APPLICATION

The present application is related to, claims priority from and incorporates by reference Japanese Patent Application No. 2013-136915, filed on Jun. 28, 2013.

TECHNICAL FIELD

The present invention relates to an image forming apparatus and a control program and can be applied to, for example, an electrophotographic image forming apparatus.

BACKGROUND

In an electrophotographic color printer capable of forming an image using cyan, magenta and yellow toner agents, it is possible that an image (hereinafter, referred to as a "gray mixed color image") that is formed by superimposedly printing cyan, magenta and yellow images so as to substantially match a monochromatic image (of an achromatic color such as gray or black) having a predetermined print density is formed on a recording sheet.

As a conventional printer capable of forming a gray mixed color image, a printer is disclosed in Patent Document 1 (Japanese Patent Laid-Open Publication No. 2002-82511).

In the printer disclosed in Patent Document 1, by using a color sample sheet on which a test print of a gray mixed color image and a color sample are printed (the color sample being formed by superimposedly printing images of the respective cyan, magenta and yellow colors, of which print densities are each increased by a predetermined amount, on a black monochromatic image), a color sample closest to the test print is selected. According to a density distribution of the selected color sample, a test print obtained by increasing or decreasing the print density of the gray mixed color image is printed. This process is repeated until the test print matches a minimum distribution density of the color sample.

However, in the printer corresponding to the conventional gray mixed color image, there is a problem that, with respect to the increased or decreased print densities of the cyan, magenta and yellow colors, a user cannot further perform fine adjustment or perform color balance adjustment for intentionally modifying hue to suit preferences of the user.

In view of the above-described problem, an image forming apparatus and a control program are desired that allow image formation density adjustment matching intention of a user to be easily performed.

SUMMARY

The first invention of the application relates to an image forming apparatus including an image forming part forming an image on a medium using developers of a plurality of colors, a sample pattern outputting part holding a sample pattern and supplying the held sample pattern to the image forming part to form an image on a medium to be output as a sample, a reference image and a plurality of color sample images being arranged in the sample pattern, the reference image being expressed by the plurality of the colors of predetermined densities, the plurality of the color sample images being formed by modifying a density of each of the plurality of the colors that are used to express the reference image by a predetermined amount, a selection part allowing a user to select one of the color sample images that configure the sample pattern, an image formation density adjustment amount holding part determining and holding image formation density adjustment amounts for increasing or decreasing image formation densities of the plurality of the colors that is used when the image forming part performs image formation, according to density distribution of the plurality of the colors that are used to express the color sample image that is selected by the user, an image formation density adjusting part adjusting image formation densities of the plurality of the colors of the image forming part, according to the image formation density adjustment amounts held by the image formation density adjustment amount holding part, a presenting part presenting to the user the image formation density adjustment amounts that are held by the image formation density adjustment amount holding part, and an image formation density adjustment amount modifying part receiving from the user modifications with respect to the image formation density adjustment amounts that are held by the image formation density adjustment amount holding part and updating the image formation density adjustment amounts that are held by the image formation density adjustment amount holding part to the image formation density adjustment amounts that is after the modification.

The second invention of the application relates to a control program controlling an image forming apparatus that has an image forming part that forms an image on a medium using developers of a plurality of colors, the control program causing a computer to function as: a sample pattern outputting part holding a sample pattern and supplying the held sample pattern to the image forming part to form an image on a medium to be output as a sample, a reference image and a plurality of color sample images being arranged in the sample pattern, the reference image being expressed by the plurality of the colors of predetermined densities, the plurality of the color sample images being formed by modifying a density of each of the plurality of the colors that are used to express the reference image by a predetermined amount; a selection part allowing a user to select one of the color sample images that configure the sample pattern; an image formation density adjustment amount holding part determining and holding image formation density adjustment amounts for increasing or decreasing image formation densities of the plurality of the colors when the image forming part performs image formation, according to density distribution of the plurality of the colors that are used to express the color sample image that is selected by the user; an image formation density adjusting part adjusting image formation densities of the plurality of the colors of the image forming part, according to the image formation density adjustment amounts; a presenting part presenting to the user the image formation density adjustment amounts; and an image formation density adjustment amount modifying part receiving from the user modifications with respect to the image formation density adjustment amounts and updating the image formation density adjustment amounts to the image formation density adjustment amounts after the modification.

The third invention of the application relates to an image forming apparatus including an adjustment sheet printing part printing an adjustment sheet, a reference image and a color sample image being arranged in the adjustment sheet, the reference image being expressed by a monochromatic developer, the color sample image being expressed by a mixed color of a plurality of developers, an input part performing input based on a printing result of the adjustment sheet, and an image forming part performing image formation, image data of the image formation being subjected to color correction based on an input result of the input part. Wherein in the adjustment sheet printing part, the monochromatic developer prints a black developer image; the plurality of the developers include three kinds of developers including a cyan developer, a magenta developer and a yellow developer; and the color sample image prints a reference color sample image that is formed by mixing amounts of the cyan developer, the magenta developer and the yellow developer based on preset thresholds, and a color sample image that is formed by increasing by two color units from the reference color sample image or a color sample image that is formed by decreasing by two color units from the reference color sample image.

The fourth invention of the application relates to an image forming apparatus including an adjustment sheet printing part printing an adjustment sheet, a reference image and a color sample image being arranged in the adjustment sheet, the reference image being expressed by a monochromatic developer, the color sample image being expressed by a mixed color of a plurality of developers, an input part performing input based on a printing result of the adjustment sheet, and an image forming part performing image formation, image data of the image formation being subjected to color correction based on an input result of the input part. Wherein in the adjustment sheet printing part, the monochromatic developer prints a black developer image; the plurality of the developers include three kinds of developers including a cyan developer, a magenta developer and a yellow developer; and the color sample image prints a reference color sample image that is formed by mixing amounts of the cyan developer, the magenta developer and the yellow developer based on preset thresholds, and a color sample image that is formed by increasing by one color unit from the reference color sample image or a color sample image that is formed by decreasing by one color unit from the reference color sample image.

According to the present invention, an image forming apparatus can be provided that allows image formation density adjustment matching intention of a user to be easily performed.

BRIEF DESCRIPTION OF THE DRAWINGS

FIG. 7 illustrates an explanatory diagram illustrating an example of color values of a reference image and respective color sample images that configure the color balance adjustment pattern that is applied in the print density adjustment management part of the first embodiment.

FIG. 8 illustrates an explanatory diagram illustrating a configuration example of a sample image selection screen that is displayed by the printer according to the first embodiment.

FIG. 14 illustrates a block diagram illustrating a functional configuration of a print density adjustment management part that configures a printer according to a second embodiment.

FIG. 17 illustrates a flow diagram illustrating operations when printing is performed in the printer according to the second embodiment.

FIGS. 21A-21C illustrate explanatory diagrams illustrating an example of color values of a reference image and respective color sample images that configure the color balance adjustment pattern that is applied in the print density adjustment management part of the third embodiment.

FIG. 22 illustrates an explanatory diagram illustrating a configuration example of a sample image selection screen that is displayed by the printer according to the third embodiment.

FIG. 23 illustrates explanatory diagram illustrating a configuration example of a print density fine adjustment screen that is displayed on the printer according to the third embodiment.

FIGS. 24A-24C illustrate explanatory diagrams illustrating transition of the print density fine adjustment screen that is displayed on the printer according to the third embodiment.

FIG. 29 illustrates explanatory diagram illustrating a configuration example of a black print density adjustment screen that is displayed on the printer according to the fourth embodiment.

FIGS. 30A and 30B illustrate explanatory diagrams illustrating transition of the black print density adjustment screen that is displayed on the printer according to the fourth embodiment.

DETAILED DESCRIPTIONS OF THE EMBODIMENTS (A) First Embodiment

In the following, with reference to the drawings, a first embodiment is described in which the image forming apparatus and the control program according to the present invention are applied to a printer.

(A-1) Configuration of First Embodiment

First, an overall configuration of a printer 1 is described.

Figure 2:
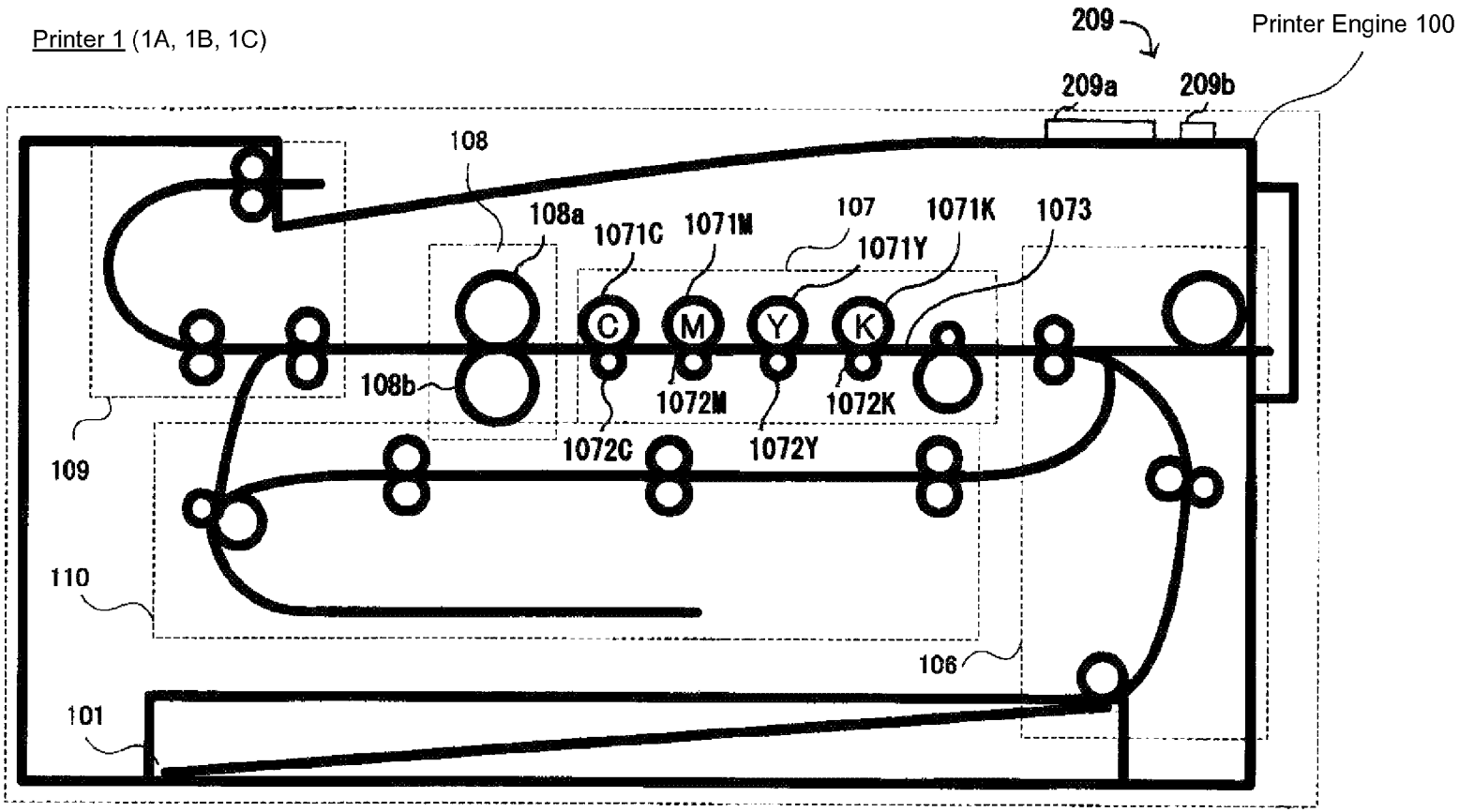
FIG. 2 illustrates a block diagram illustrating a functional configuration of the printer according to the first embodiment.
Figure 3:
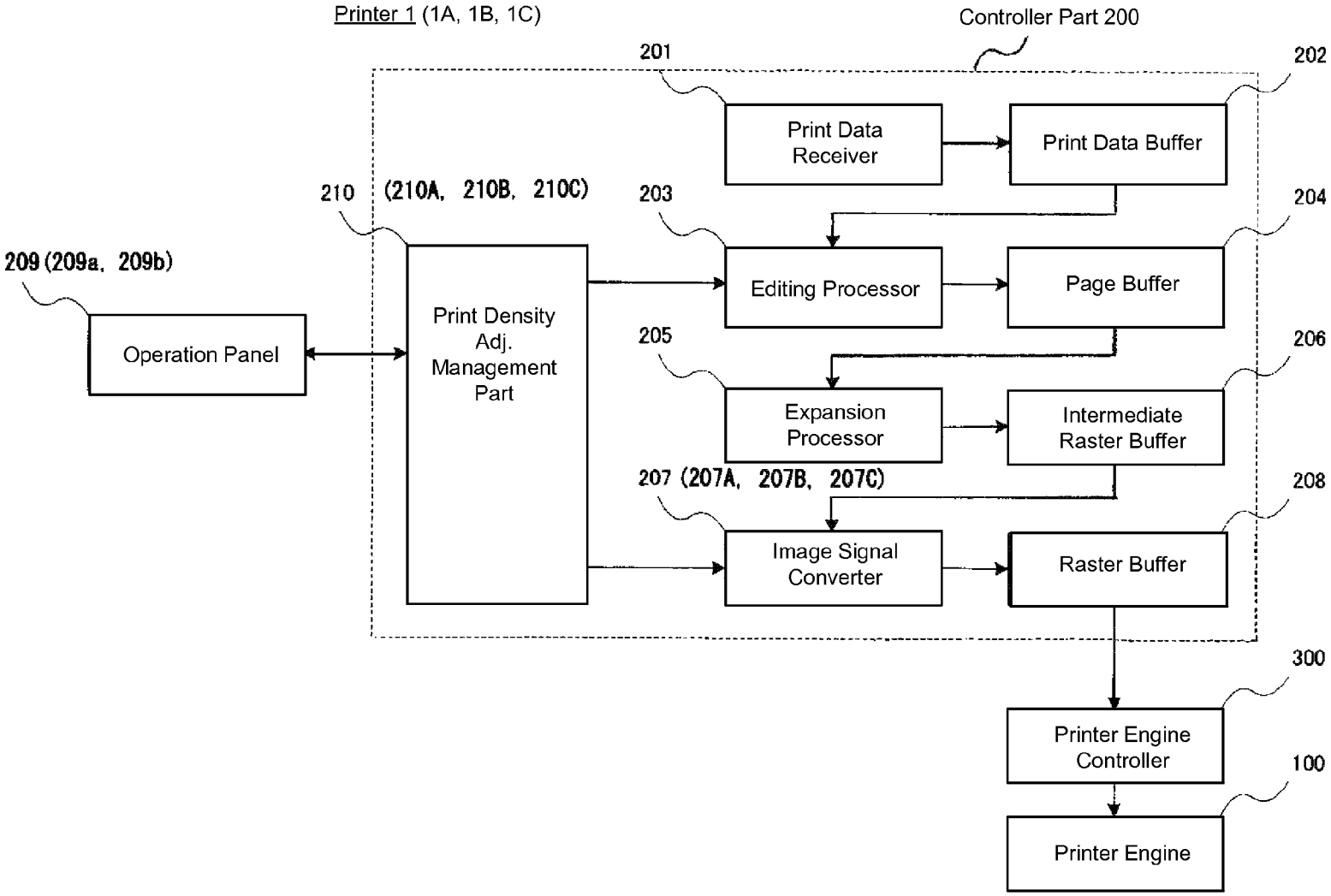
FIG. 3 illustrates a schematic side cross-sectional view of the printer according to the first embodiment.

FIG. 2 illustrates a block diagram of a functional configuration of the printer 1. FIG. 3 illustrates a schematic side cross-sectional view of the printer 1 of this embodiment.

As illustrated in FIG. 2, the printer 1 has, roughly, a printer engine 100, a controller 200 and a printer engine controller 300.

As illustrated in FIG. 3, the printer engine 100 has a sheet feeding tray 101, a sheet feeding part 106, an image forming part 107, a fuser 108, an ejection part 109, a duplex printing unit 110 and an operation panel 111.

The sheet feeding tray 101 is a tray in which print sheets P are stacked and contained. During printing, among the print sheets P in the sheet feeding tray 101, the print sheet P positioned on an upper side in a stacking direction of the sheet feeding tray 101 is fed one by one by the sheet feeding part 106 to the image forming part 107, and printing is performed in the image forming part 107 as one print job based on print data sent to the printer 1. The sheet feeding part 106 is a carrying path that is configured by a belt, rollers and the like (not illustrated in the drawings).

The image forming part 107 can form an image using toner agents of a plurality of colors. In this embodiment, as an example, the image forming part 107 is described as being capable of forming an image using toner agents of four colors including black (hereinafter, also denoted as "K"), yellow (hereinafter, also denoted as "Y"), magenta (hereinafter, also denoted as "M") and cyan (hereinafter, also denoted as "C"). The image forming part 107 has image forming units 1071 (1071K, 1071Y, 1071M, 1071C) corresponding to the respective toner colors, transfer rollers 1072 (1072K, 1072Y, 1072M, 1072C) corresponding to the respective image forming units 1071, a carrying belt 1073 that carries the print sheet P inside the image forming part 107, and LED (Light Emitting Diode) heads 1074 (1074K, 1074Y, 1074M, 1074C) as exposure parts that emit recording light.

The four image forming units 1071 are LED (Light Emitting Diode) type digital color printers (electrophotographic printers in which a toner image based on recording light due to LEDs is developed and transferred onto the print sheet P) and are sequentially arranged from an insertion side to an ejection side of the print sheet P (arranged along the carrying belt 1073).

Figure 4:
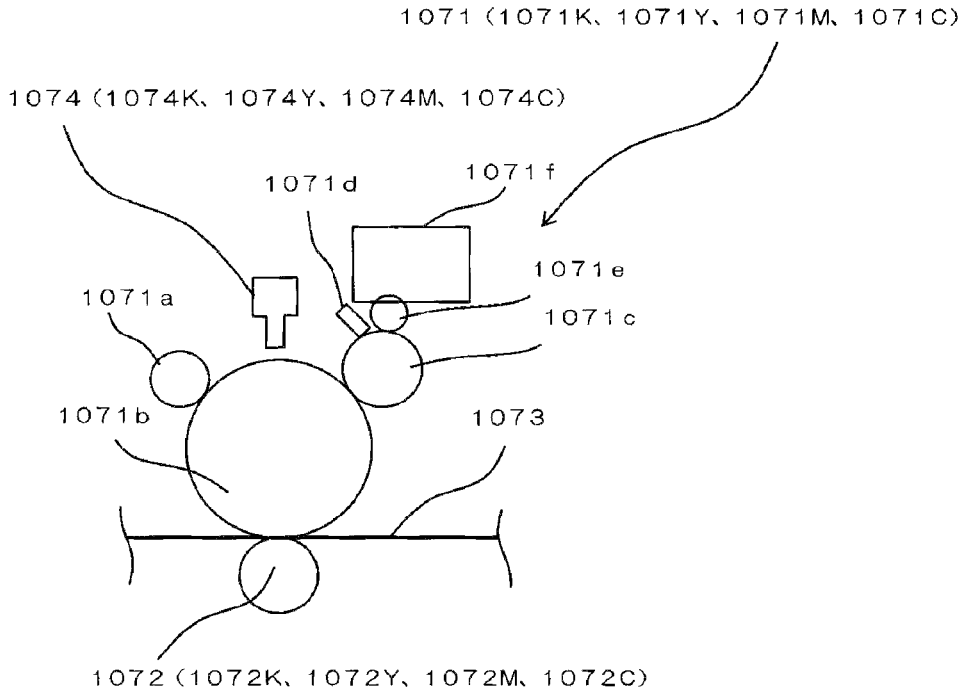
FIG. 4 illustrates a schematic side view of periphery of one image forming unit that configures the printer according to the first embodiment.

Next, an internal configuration of the image forming unit 1071 of each color is described using FIG. 4. FIG. 4 illustrates a side view of periphery of one image forming unit 1071. The image forming units 1071 of the respective colors have the same configuration except that colors of the toner agents being used are different from each other.

Each of the image forming units 1071 (1071K, 1071Y, 1071M, 1071C) has a charging roller 1071*a*, a photosensitive drum 1071*b*, a development roller 1071*c*, a development blade 1071*d*, a toner supply roller 1071*e* and a toner cartridge 1071*f*.

The charging roller 1071*a* uniformly charges a surface of the photosensitive drum 1071*b*. The toner cartridge 107*f* supplies toner via the development roller 1071*c* to the photosensitive drum 1071*b*. The photosensitive drum 1071*b* is for forming a toner image (electrostatic latent image) that corresponds to recording light emitted from the LED head 1074. After the photosensitive drum 1071*b* is uniformly charged by the charging roller 1071*a*, when the recording light of the LED head 1074 is emitted, an electrostatic latent image is formed on the surface of the photosensitive drum 1071*b*. The toner agent of the toner cartridge 107*f* is first supplied by the toner supply roller 1071*e* to the surface of the development roller 1071*c* and the toner agent on the surface of the development roller 1071*c* is regulated by the development blade 1071*d* to have a certain layer thickness. Next, when the toner agent is supplied from the development roller 1071*c* to the electrostatic latent image that is formed on the surface of the photosensitive drum 1071*b*, a toner image is developed (formed).

Further, in the image forming part 107, at a position opposing (across the carrying belt 1073) the photosensitive drum 1071*b* of each of the image forming units 1071 of the respective toner colors, the transfer roller 1072. The transfer roller 1072 of each toner color is pressed in a direction of the opposing photosensitive drum 1071*b*. The print sheet P that is carried on the carrying belt 1073 is sandwiched between the transfer roller 1072 of each color and the opposing photosensitive drum 1071*b*, and the toner image that is developed on the opposing photosensitive drum 1071*b* is transferred to the print sheet P.

After the toner image is transferred in the image forming part 107, the print sheet P is carried to the fuser 108. The fuser 108 has a fuser roller 108*a* and a pressure application roller 108*b*. In the fuser 108, for example, because of heat due to a heat and the like and pressure due to the rollers, the toner on the print sheet P having the toner image formed in the image forming part 107 is fused. Next, the print sheet P having the toner image thereon subjected to a fusing process by the fuser 108 is ejected to outside of the apparatus by the ejection part 109. The ejection part 109 is a carrying path that is configured by a belt, rollers and the like (not illustrated in the drawings).

The duplex printing unit 110 is provided on a more downstream side than the fuser 108 in the carrying path of the print sheet P (on the carrying path of the ejection part 109). Specifically, the duplex printing unit 110 can receive the print sheet P from a branch point on the carrying path that is configured by the ejection part 109 (for example, from a branch point of a carrying path that is branched by a blade or the like (not illustrated in the drawings)).

The duplex printing unit 110 reverses the print sheet P having one surface on which the toner image is fused, and again carries the print sheet P to the image forming part 107 (re-feeds the print sheet P to the sheet feeding part 106) so as to allow a toner image to be attached to the other surface thereof on which the toner image is not fused.

The operation panel 111 displays status of the printer 1 or a message to a user, and receives input from the user with respect to the printer 1. On the operation panel 111, a touch panel type display 209*a* for performing information output (including output of an operation screen) to the user and performing operation reception and an operation key 209*b* (which may also be a plurality of keys) for receiving an operation from the user are provided.

Next, a functional configuration of the printer 1 is described using FIG. 2.

The controller 200 has a print data receiver 201, a print data buffer 202, an editing processor 203, a page buffer 204, an expansion processor 205, an intermediate raster buffer 206, an image signal converter 207, a raster buffer 208 and a print density adjustment management part 210.

The print data receiver 201 is an interface (such as a network line or a USB (not illustrated in the drawings)) that connects to an external device (such as a PC as a host device) and receives data (hereinafter, referred to as "print data") for image formation from the external device.

The print data buffer 202 is a buffer that temporarily stores the print data received by the print data receiver 201.

The editing processor 203 reads the print data from the print data buffer 202 or the print density adjustment management part 210, performs command analysis or generation of drawing data for each page, and converts a result of the command analysis into code data (hereinafter, this data is also referred to as "display code") in a format capable of being processed inside the printer 1 and stores the display code in the page buffer 204. In this embodiment, an image signal contained in the print data is represented by 8-bit values of respective RGB or CMYK colors. For an image represented in RGB, an image signal is converted into a display code by converting the image signal into an image signal represented by 8-bit values of the respective CMYK colors in advance by a predetermined process (for example, a conversion processing method same as that used in a conventional printer). In the following, red, green and blue are also respectively referred to as "R", "G" and "B."

The expansion processor 205 reads display codes of one page from the page buffer 204, converts print content of the entire page into a raster image and stores the raster image in the intermediate raster buffer 206.

The image signal converter 207 reads a raster image of one page from the intermediate raster buffer 206, converts 8-bit image signal values of the respective CMYK colors into 1-bit image signal values of the respective CMYK colors that are printable by the printer engine, and stores the raster image after the conversion in the raster buffer 208. However, when the 8-bit image signal values of the respective CMYK colors are read, print density adjustment amounts of the respective cyan, magenta and yellow colors that are stored in the print density adjustment management part 210 (to be described later) are input, and, based on the print density adjustment amounts, the C, M, Y image signal values are converted (print density adjustment is executed).

The print density adjustment management part 210 holds a color balance adjustment pattern and a print density adjustment amount, and, according to a request from the user via the operation panel 111, performs a start operation of printing the color balance adjustment pattern, determination of the print density adjustment amount, fine adjustment of the print density adjustment amount, and the like.

The printer engine controller 300 reads a raster image of one page from the raster buffer 208, causes the printer engine 100 to operate, and performs printing of the input raster image.

Figure 1:
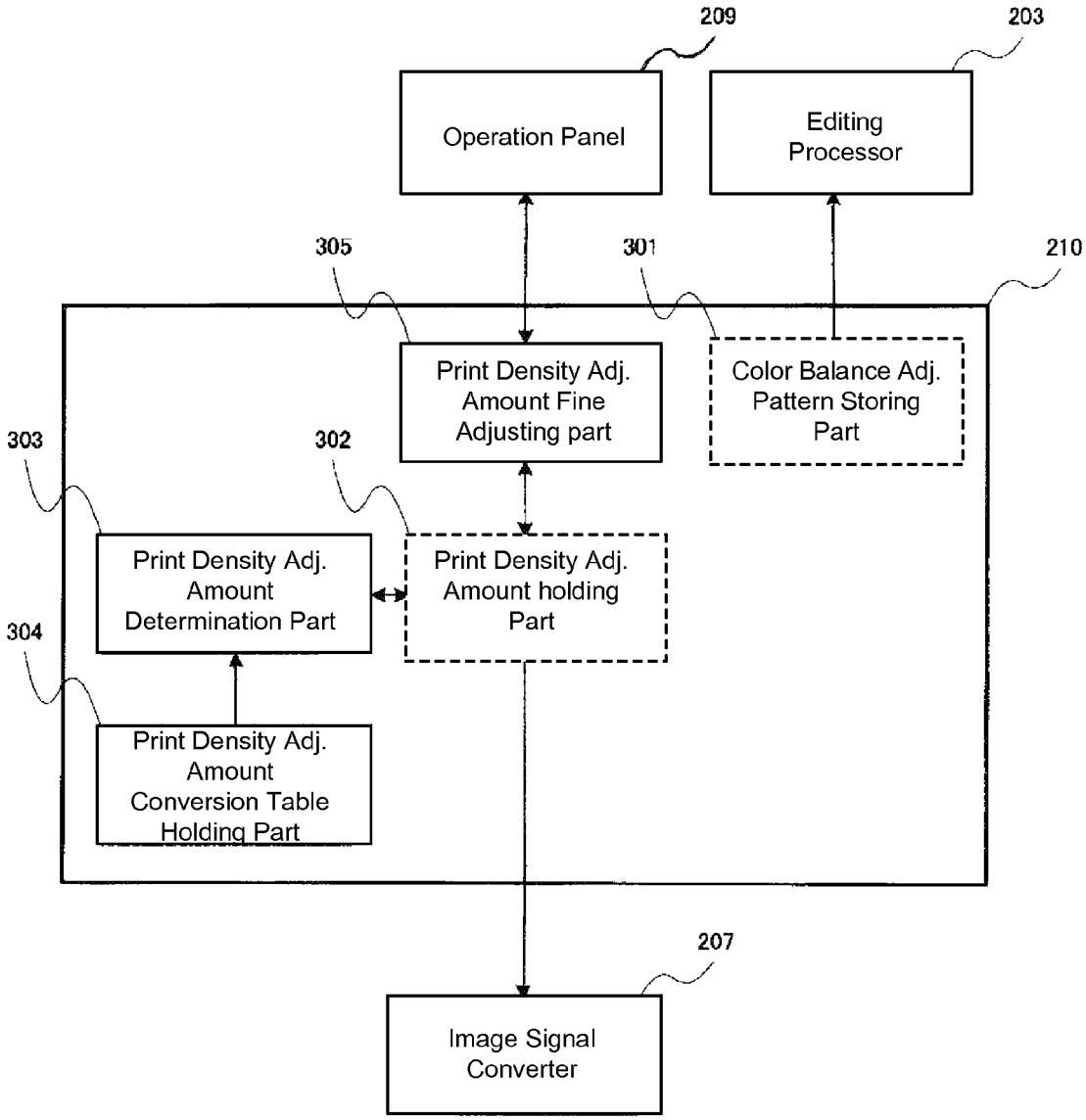
FIG. 1 illustrates a block diagram of a functional configuration of a print density adjustment management part that configures a printer according to a first embodiment.

Next, a configuration of the print density adjustment management part 210 is described using FIG. 1.

First, an outline of the print density adjustment management part 210 is described. The print density adjustment management part 210, cooperating (in conjunction) with the operation panel 209 and the like, has the following three functions (roles) related to print density adjustment.

A first function of the print density adjustment management part 210 is a function (hereinafter, referred to as a "color balance adjustment pattern output function") to, based on an operation from the user via the operation panel 111, start printing of a pattern (hereinafter, also referred to as a "color balance adjustment pattern") of a plurality of sample images (test print images) according to a print density adjustment (hereinafter, the print sheet P on which the color balance adjustment pattern is printed is referred to as a "color balance adjustment sheet").

Further, a second function of the print density adjustment management part 210 is a function (hereinafter, referred to as a "print density adjustment amount determination function") to receive a selection of a sample image (such as an input of a number assigned to the sample image) that appears to be most achromatic (or a sample image of a color that is closest to a black monochromatic image) from the user using the operation panel 209 based on a color adjustment sheet printed based on the color balance adjustment pattern, and to determine, based on the selected sample image, print density adjustment amounts of cyan, magenta and yellow.

Further, a third function of the print density adjustment management part 210 is a function (hereinafter, referred to as a "print density fine adjustment function") to fine adjust the print density adjustment amounts of cyan, magenta and yellow by an operation from the user via the operation panel 111.

First, a process according to the color balance adjustment pattern output function (the first function) of the print density adjustment management part 210 is described in detail.

The print density adjustment management part 210 can display, on the display 209*a* of the operation panel 209, an operation screen (hereinafter, referred to as a "color balance adjustment pattern print reception screen") for receiving an operation from the user to start printing of the color balance adjustment pattern.

Figure 5:
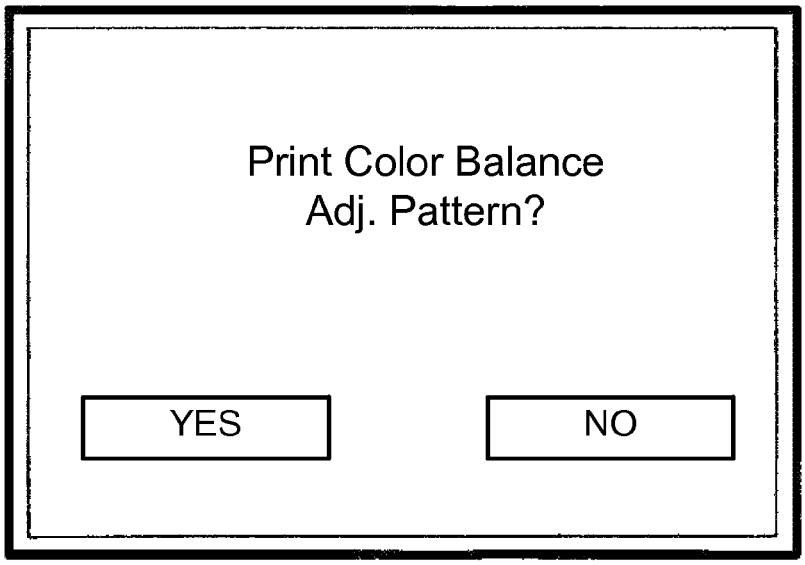
FIG. 5 illustrates an explanatory diagram illustrating a configuration example of a color balance adjustment pattern print reception screen that is displayed on the printer according to the first embodiment.

As the color balance adjustment pattern print reception screen, for example, as illustrated in FIG. 5, an operation screen can be applied in which a message such as "Do you want to print a color balance adjustment pattern?", a button (labeled "Yes") for starting printing, and a button (labeled "No") for terminating the process without performing printing are arranged. When the button labeled "Yes" in the operation screen of FIG. 5 is pressed by the user, the print density adjustment management part 210 controls the printer engine controller 300 to cause the printer engine 100 to execute printing of the color balance adjustment pattern (output of the color balance adjustment sheet). In the printer 1, for example, by an operation of a menu screen (for example, a menu screen of a hierarchical structure) and the like (not illustrated in the drawings) using the operation panel 111, the operation screen as illustrated in FIG. 5 can be brought up.

Figure 6:
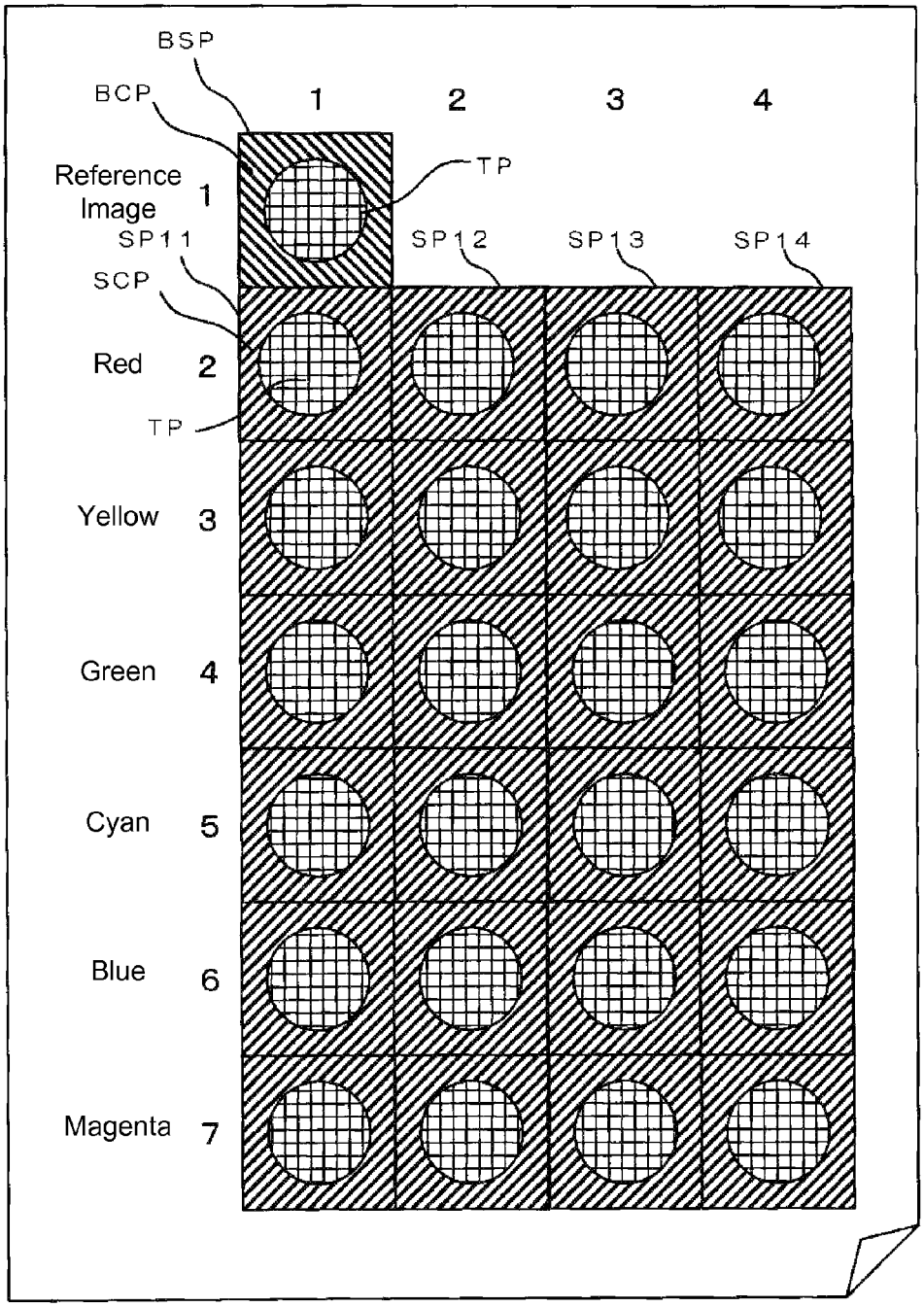
FIG. 6 illustrates an explanatory diagram illustrating a configuration example of a color balance adjustment pattern (color balance adjustment sheet) that is applied in the print density adjustment management part of the first embodiment.

Next, in response to an operation from the user, the print density adjustment management part 210 outputs a color balance adjustment sheet on which a color balance adjustment pattern configured by a plurality of sample images, for example, as illustrated in FIG. 6 is printed.

In the color balance adjustment sheet illustrated in FIG. 6, a rectangular reference sample image BSP and a plurality of rectangular sample images SP are arranged. In each sample image SP, at a center portion of a mixed color image due to cyan, magenta and yellow toner agents (a rectangular image, which is hereinafter referred to as a "color sample image SCP"), a black monochromatic image (a circular image; hereinafter this monochromatic image is referred to as a "target image TP") is arranged. Similarly, in the reference sample image BSP, a rectangular mixed color reference image BCP and a circular black monochromatic target image TP are arranged.

In FIG. 6, for convenience of illustration, the reference image BCP, the target images TP and the color sample images SCP are respectively illustrated using different hatching patterns. Further, in FIG. 6, for convenience of illustration, all color sample images SCP are illustrated using the same hatching. However, in practice, as will be described later, each color sample image SCP has different densities of the respective colors.

The target image TP is a sample of a target that is to be an indicator when the user selects an image that appears to be most achromatic, and, for all the sample images SP and the reference sample image BSP, colors based on the same color value (parameter) are set. It is preferable that this image is printed using a black monochromatic color that does not cause a change in hue even when a change occurs during a printing process. Therefore, in this embodiment, a black monochromatic color value is set for the target image TP. Further, in this embodiment, in order to make 50% print density of the black monochromatic color as a reference of print density adjustment for cyan, magenta and yellow, (C, M, Y, K)=(0, 0, 0, 128) are set as color values for the target image TP. In this embodiment, color values are all represented using 8-bit values (values in a range of 0-255 in decimal). Therefore, 0 means 0%, 128 means 50% and 255 means 100%.

As the reference image BCP, an image of a color represented by a mixed color of cyan, magenta and yellow that colorimetrically matches the target image TP in a correctly calibrated state is applied. In this embodiment, for the reference image BCP, a color that colorimetrically matches the target image TP in a case where cyan, magenta and yellow, each at 40%, are mixed is applied. Specifically, color values of (C, M, Y, K)=(102, 102, 102, 0) are set for the reference image BCP.

In the color balance adjustment pattern, the reference sample image BSP and the sample images SP are aligned and arranged in a matrix form. As illustrated in FIG. 6, in the color balance adjustment pattern, regions are set allowing the reference sample image BSP and the sample images SP to be arranged in a matrix shape of 7 rows×4 columns (vertically 7 cells×horizontally 4 cells). In the following, in the matrix that illustrates the color balance adjustment pattern, the respective rows are assigned row numbers 1-7 in an order starting from the top row, and the respective columns are assigned column numbers 1-4 in an order starting from the leftmost column. Further, in the following, as an identification number indicating each of the regions (cells) that configure the matrix, a number (hereinafter, referred to as an "image number" or a "matrix number") that is represented by a combination of a row number and a column number is used. For example, an image number (matrix number) of a region (cell) of the row number 1 and the column number 1 is 11. The number and the arrangement of the sample images SP of the matrix that configures the color balance adjustment pattern are not limited.

In the color balance adjustment pattern of this embodiment, in the region of the image number 11, the reference sample image BSP is arranged. Further, in the row of the row number 1, only the reference sample image BSP is arranged. Further, in the rows of the row numbers 2-7, the sample images SP of the column numbers 1-4 are respectively arranged. In the following, each sample image SP is described by being assigned a reference numeral symbol of "sample image SPYX" (Y: row number, X: column number). For example, the sample image SP of the row number 2 and the column number 2 has a reference numeral symbol of "SP22." Further, the color sample image SCP of the each sample image SP is similarly described by being assigned a reference numeral symbol of "color sample image SCPYX" (Y: row number, X: column number).

The color sample images SCP that configure the respective sample images SP are images of colors of which print densities of cyan, magenta and yellow are each changed by a predetermined amount with respect to the reference image BCP of the reference sample image BSP.

For the color sample images SCP of the row numbers 2-7, images of which hues of colors corresponding to the respective rows are shifted with respect to the reference image BCP are respectively set. In the following, the colors corresponding to the above-described respective rows are referred to as "shift target colors."

For the rows of the row numbers 2-7, red, yellow, green, cyan, blue and magenta are respectively set as the shift target colors. For the color sample images SCP of each of the rows, images, of which print densities of cyan, magenta and yellow are each changed by a predetermined amount so that the hue shifts toward a direction of the shift target color, are applied to the color sample images SCP.

In each of the rows, images of colors for which the hue of the shift target color becomes darker in the order of the column numbers 1-4 are applied as the color sample images SCP. Specifically, in each of the rows, the print densities of cyan, magenta and yellow are each changed by a predetermined amount in such a manner that the hue of the color sample image SCP of the column of the column number 1 is shifted in a direction that the hue of the shift target color is "lighter" with respect to the reference image BCP, the hue of the color sample image SCP of the column of the column number 2 is shifted in a direction that the hue of the shift target color is "slightly lighter" with respect to the reference image BCP, the hue of the color sample image SCP of the column of the column number 3 is shifted in a direction that the hue of the shift target color is "slightly darker," and the hue of the color sample image SCP of the column of the column number 4 is shifted in a direction that the hue of the shift target color is "darker." In this embodiment, among color values of cyan, magenta and yellow of the reference image BCP, color values of one color or a plurality of colors (in this embodiment, one color or two colors) are each shifted by a predetermined amount (hereinafter, this shifted amount is referred to as a "shift amount"); thereby, the hue of the shift target color is changed and the color values of each of the color sample images SCP are set. In this embodiment, as shift amounts with respect to the color values of the reference image BCP, "−10" is set to the print density adjustment amount of the "light" direction; "−5" is set to the print density adjustment amount of the "slightly light" direction; "+5" is set to the print density adjustment amount of the "slightly dark" direction; and "+10" is set to the print density adjustment amount of the "dark" direction.

FIG. 7 illustrates an example of color values of the respective colors of a case where the color values of the reference image BCP and the respective color sample images SCP of the color balance adjustment pattern are represented in a CMY color space.

In the example of FIG. 7, the color values of the reference image BCP are set to be (C, M, Y, K)=(102, 102, 102, 0), and the color values of the respective color sample images SCP are set as in a case where −10, −5, +5, or +10 of the above-described example are applied to the shift amounts of the respective columns (of the column numbers 1-4).

In the following, for the respective color sample images SCP, differences with respect to the color values (the respective color values of CMYK) of the reference image BCP are referred to as "print density adjustment amounts." In the following, print density adjustment amounts of cyan, magenta and yellow are respectively represented using Δc, Δm and Δy. For example, in FIG. 7, in the color sample image SCP24 corresponding to the row number 2 and column number 4 , since the color values are adjusted from "(C, M, Y, K)=(102, 102, 102, 0)" of the reference image BCP to "(C, M, Y, K)=(102, 112, 112, 0)," the print density adjustment amounts are Δc=0, Δm=+10 and Δy=+10.

In the case where the color balance adjustment pattern is printed in the printer 1, when it is in a correctly calibrated state, the reference image BCP appears to be most achromatic. Therefore, the reference image BCP appears to match the target image. However, when it deviates from a calibrated state, one of the color sample images appears to be most achromatic. That is, one of the color sample images appears to match the target image TP.

Next, a process according to the print density adjustment amount determination function (the second function) of the print density adjustment management part 210 is described in detail.

The print density adjustment management part 210 outputs the color balance adjustment sheet on which the color balance adjustment pattern is printed and further displays, on the operation panel 209 (display 209*a*), a screen (hereinafter, referred to as a "sample image selection screen") for allowing the user to select a sample image SP (color sample image SCP) that appears to be most achromatic on the color balance adjustment pattern. As the sample image selection screen, for example, as illustrated in FIG. 8, a screen can be applied in which a message such as that "Please specify the number of the image that appears to be most achromatic in the color adjustment sheet" and fields that can receive inputs of numbers (a row number and a column number) of an image from the user are arranged. The print density adjustment management part 210 temporarily holds, as parameter of color values that are used as composite black in the printer 1, the color values of the color sample image SCP that is selected using the sample image selection screen that is displayed by the print density adjustment amount determination function.

Next, a process according to the print density fine adjustment function (the third function) of the print density adjustment management part 210 is described in detail.

Figure 9:
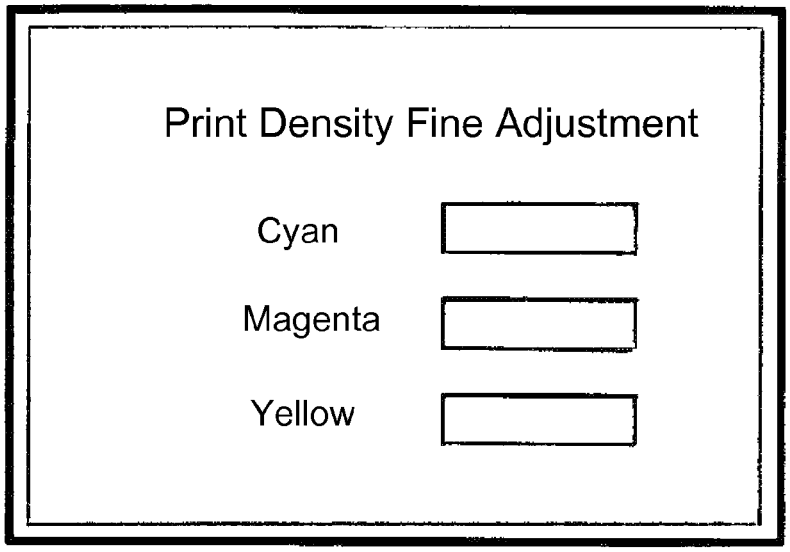
FIG. 9 illustrates explanatory diagram illustrating a configuration example of a print density fine adjustment screen that is displayed on the printer according to the first embodiment.
Figure 10A:
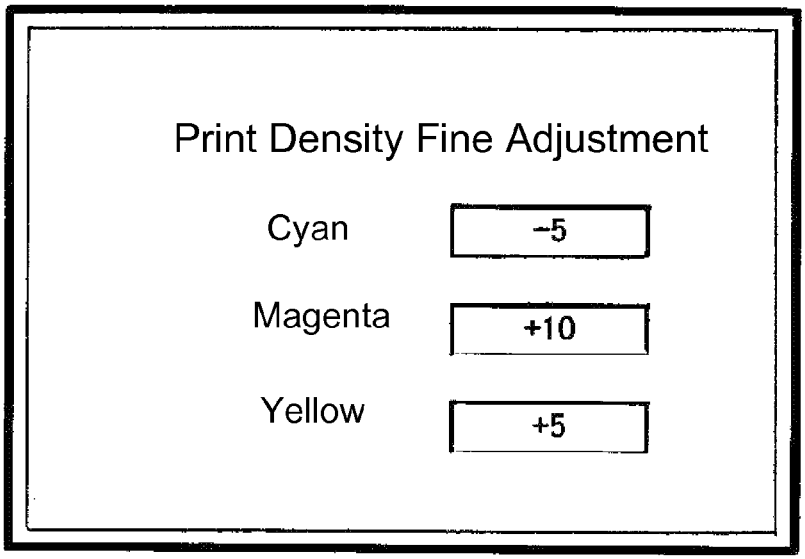
FIGS. 10A-10C illustrate explanatory diagrams illustrating transition of the print density fine adjustment screen that is displayed on the printer according to the first embodiment.

The print density adjustment management part 210 displays the print density adjustment amounts that are held by the print density adjustment management part 210 at the time, and displays, on the operation panel 209 (display 209*a*), an operation screen (hereinafter, referred to as a "print density fine adjustment screen") that allows the print density adjustment amounts to be fine adjusted. As the sample image selection screen, for example, as illustrated in FIG. 9, a screen can be applied in which print density adjustment amounts respectively with respect to cyan, magenta and yellow are displayed and fields that allow the displayed respective print density adjustment amounts to be modified (allow the values to be modified) are arranged. In FIG. 10A, a state is illustrated in which the print density adjustment amounts held by the print density adjustment management part 210 or the print density adjustment amounts after the fine adjustment are $$\Delta c=-5, \Delta m=+10 \text{ and } \Delta y=+5.$$

Next, configuration elements of the print density adjustment management part 210 are described.

The print density adjustment management part 210 has a color balance adjustment pattern storing part 301, a print density adjustment amount holding part 302, a print density adjustment amount determination part 303, a print density adjustment amount conversion table holding part 304 and a print density adjustment amount fine adjusting part 305.

The controller 200 that contains the print density adjustment management part 210 may be realized using software, for example, by installing the control program of the embodiment and the like to a computer having a processor and a memory, and may also be realized in part or in whole using hardware (for example, using a dedicated chip or the like).

The color balance adjustment pattern storing part 301 is a storage that stores entire image data of the color balance adjustment pattern (see above-described FIG. 6). The print density adjustment management part 210, due to the print density adjustment amount determination function, in response to an operation from the operation panel 111, supplies the image data of the color balance adjustment pattern to the editing processor 203 and starts printing (printing to the print sheet P).

The print density adjustment amount holding part 302 has a function of holding the print density adjustment amounts of cyan, magenta and yellow. The print density adjustment amount holding part 302 holds the print density adjustment amounts (increase or decrease amounts of the color values with respect to the respective cyan, magenta and yellow color values of the reference image BCP) that are determined by using the print density adjustment amount determination function (the sample image selection screen), and thereafter, when the print density adjustment amounts are fine adjusted by using the print density fine adjustment function (the print density fine adjustment screen), holds the print density adjustment amounts after the fine adjustment.

The print density adjustment amount conversion table holding part 304 holds the color values (the respective color values of cyan, magenta and yellow) of the respective kinds of images (including the reference image BCP and the respective color sample images SCP) that are arranged in the color balance adjustment pattern (for example, holds table information as illustrated in FIG. 7 as a print density adjustment amount conversion table).

The print density adjustment amount determination part 303 displays the sample image selection screen on the operation panel 209 (display 209*a*), receives a selection of image number (selection of the print density adjustment amounts) from the user, and obtains, from the print density adjustment amount conversion table holding part 304, the color values of the color sample image SCP that corresponds to the received image number. The print density adjustment amount determination part 303 obtains, from the print density adjustment amount conversion table holding part 304, differences between the color values of the reference image BCP and the color values of the selected color sample image SCP as the print density adjustment amounts. The print density adjustment amount determination part 303 supplies the obtained print density adjustment amounts to the print density adjustment amount holding part 302 to be held therein.

The print density adjustment amount fine adjusting part 305 displays the print density fine adjustment screen on the operation panel 209 (display 209*a*) (displays the print density adjustment amounts held by the print density adjustment amount holding part 302), and receives, from the user, fine adjustments (increase or decrease) of the print density adjustment amounts held by the print density adjustment amount holding part 302. The print density adjustment amount fine adjusting part 305 supplies the fine adjusted print density adjustment amounts to the print density adjustment amount holding part 302 to be held therein. Next, details of a determination method of the print density adjustment amounts in the print density adjustment management part 210B (the print density adjustment amount determination part 303) are described using also FIG. 9.

Figure 10B:
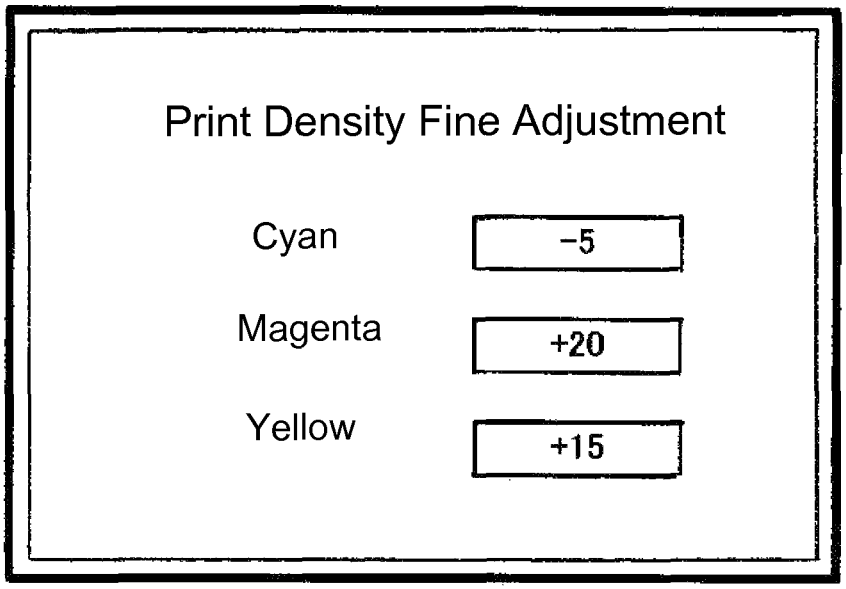
Figure 10C:
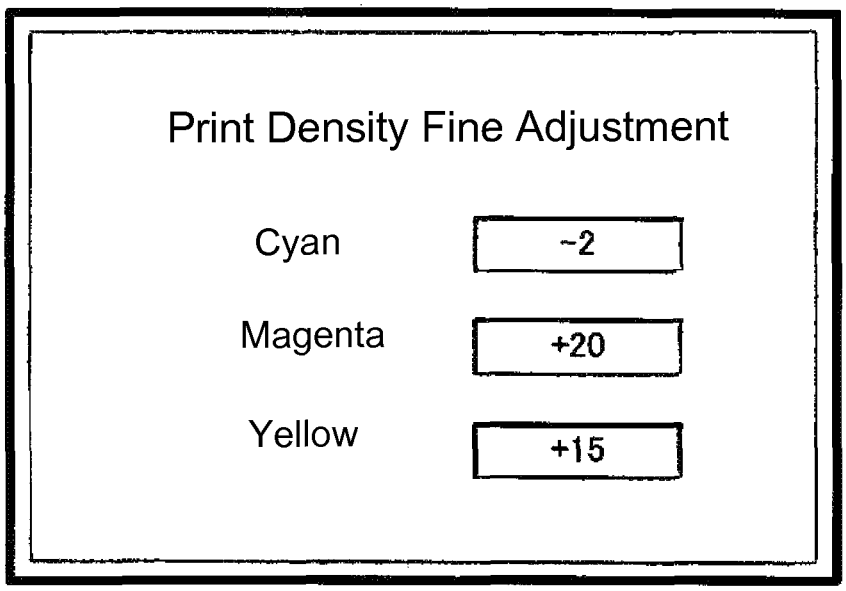

FIGS. 10A-10C illustrate transition of the print density adjustment amounts (the print density adjustment amounts that are held by the print density adjustment amount holding part 302) that are fine adjusted (updated) by using the print density fine adjustment function (the print density fine adjustment screen). FIG. 10A illustrates a state in which the current print density adjustment amounts are Δc=−5, Δm=+10 and Δy=+5. FIG. 10B illustrates a state in which the print density adjustment amounts are adjusted to be Δc=−5, Δm=+20 and Δy=+15. Further, FIG. 10C illustrates a state in which the print density adjustment amounts are fine adjusted to be Δc=−2, Δm=+20 and Δy=+15.

Adjustment of the print densities in the image signal converter 207 of this embodiment is performed using power functions. Therefore, in the print density adjustment amount determination part 303, based on the print density adjustment amounts of cyan, magenta and yellow that are set at the time, exponents that are applied to the adjustment of the print densities of the image signal converter 207 are calculated.

When the "exponents" that are applied to the adjustment of the print densities of cyan, magenta and yellow are respectively Nc, Nm and Ny and the print density adjustment amounts of cyan, magenta and yellow that are set at the time are respectively Δc, Δm and Δy, the "exponents Nc, Nm and Ny" are calculated using the following formulas (1)-(3).

$$Nc=\log((\Delta c+102)/255)/\log(102/255) \quad (1)$$

$$Nm=\log((\Delta m+102)/255)/\log(102/255) \quad (2)$$

$$Ny=\log((\Delta y+102)/255)/\log(102/255) \quad (3)$$

The numbers "102" in the above formulas (1)-(3) are the respective color values of cyan, magenta and yellow that are respectively set for the reference image BCP. Further, Δc, Δm and Δy are respectively the print density adjustment amounts of cyan, magenta and yellow that are held in the print density adjustment amount holding part 302 at the time. For example, when the respective print density adjustment amounts of cyan, magenta and yellow that are held in the print density adjustment amount holding part 302 are Δc=−5, Δm=+10 and Δy=+5, the exponents that respectively correspond to cyan, magenta and yellow are Nc=1.055, Nm=0.898 and Ny=0.948. That is, color values of an image that is printed at the time are converted in the image signal converter 207 using the following formulas (4)-(6).

$$C'=\text{power}(C/255,Nc)*255 \quad (4)$$

$$M'=\text{power}(M/255,Nm)*255 \quad (5)$$

$$Y'=\text{power}(Y/255,Ym)*255 \quad (6)$$

In this case, when the image number that is input from the operation panel 209 in the print density adjustment operation using the color adjustment sheet is 24, the color values of the color sample image SCP that appears to be most achromatic at the time are (C, M, Y, K)=(102, 112, 112, 0) corresponding to the image number 24 of the print density adjustment amount conversion table. However, when the color values are printed, conversion of the color values is performed based on the print density adjustment amounts at the time. Therefore, color values that are actually printed are values illustrated by the following formulas (7)-(9).

$$C'=\text{power}(102/255,1.055)=97 \quad (7)$$

$$M'=\text{power}(112/255,0.898)=122 \quad (8)$$

$$Y'=\text{power}(112/255,0.948)=117 \quad (9)$$

That is, the original differences between (C, M, Y, K)=(102, 102, 102, 0) that are the color values of the reference image BCP that appears to be achromatic and the color values that are converted based on the print density adjustment amounts at the time with respect to the image that appears to be most achromatic and that is selected in the print density adjustment operation become now the print density adjustment amounts that are determined by the print density adjustment operation using the color adjustment sheet. Specifically, the color values after print density adjustment of the selected image that appears to be most achromatic become (C, M, Y, K)=(97, 122, 117, 0). Therefore, the respective print density adjustment amounts of cyan, magenta and yellow take values of the following formulas (10)-(12).

$$\Delta c'=97-102=-5 \quad (10)$$

$$\Delta m'=122-102=+20 \quad (11)$$

$$\Delta y'=117-102=+15 \quad (12)$$

The values of the calculated Δc', Δm' and Δy' are held in the print density adjustment amount holding part 302 as new print density adjustment amount.

Thereafter, when the print density fine adjustment is performed by the user, the display of the operation panel 209 (display 209*a*) becomes the display illustrated in FIG. 10B. In this case, when the user judges that fine adjustment is necessary, the user can fine adjust, via the operation panel 209, the print density adjustment amounts that are displayed on the operation panel 209. For example, when the user judges that the hue of cyan should be little stronger, the hue of cyan can be enhanced by modifying the print density adjustment amount of cyan in a + direction, for example, by modifying −5 to −2. The display of the operation panel 209 (display 209*a*) after the above fine adjustment is performed becomes the display illustrated in FIG. 10C.

As described above, in the printer 1, by the print density adjustment management part 210 (the color balance adjustment pattern storing part 301) and the printer engine controller 300, a sample pattern outputting part is configured for outputting the color balance adjustment sheet (sample adjustment sheet) on which the color balance adjustment pattern (sample pattern) is printed. Further, in the printer 1, by the operation panel 209 and the print density adjustment management part 210 (the print density adjustment amount holding part 302 and the print density adjustment amount determination part 303), a selection part is configured. Further, in the printer 1, by the print density adjustment management part 210 (the print density adjustment amount holding part 302), an image formation density adjustment amount holding part is configured. Further, in the printer 1, by the operation panel 209 and the print density adjustment management part 210 (the print density adjustment amount holding part 302 and the print density adjustment amount fine adjusting part 305), image formation density adjustment amount modifying part and presenting part are configured. Further, in the printer 1, by the image signal converter 207, an image formation density adjusting part is configured.

(A-2) Operation of First Embodiment

Next, an operation of the printer 1 of the first embodiment having the above configuration is described.

Figure 11:
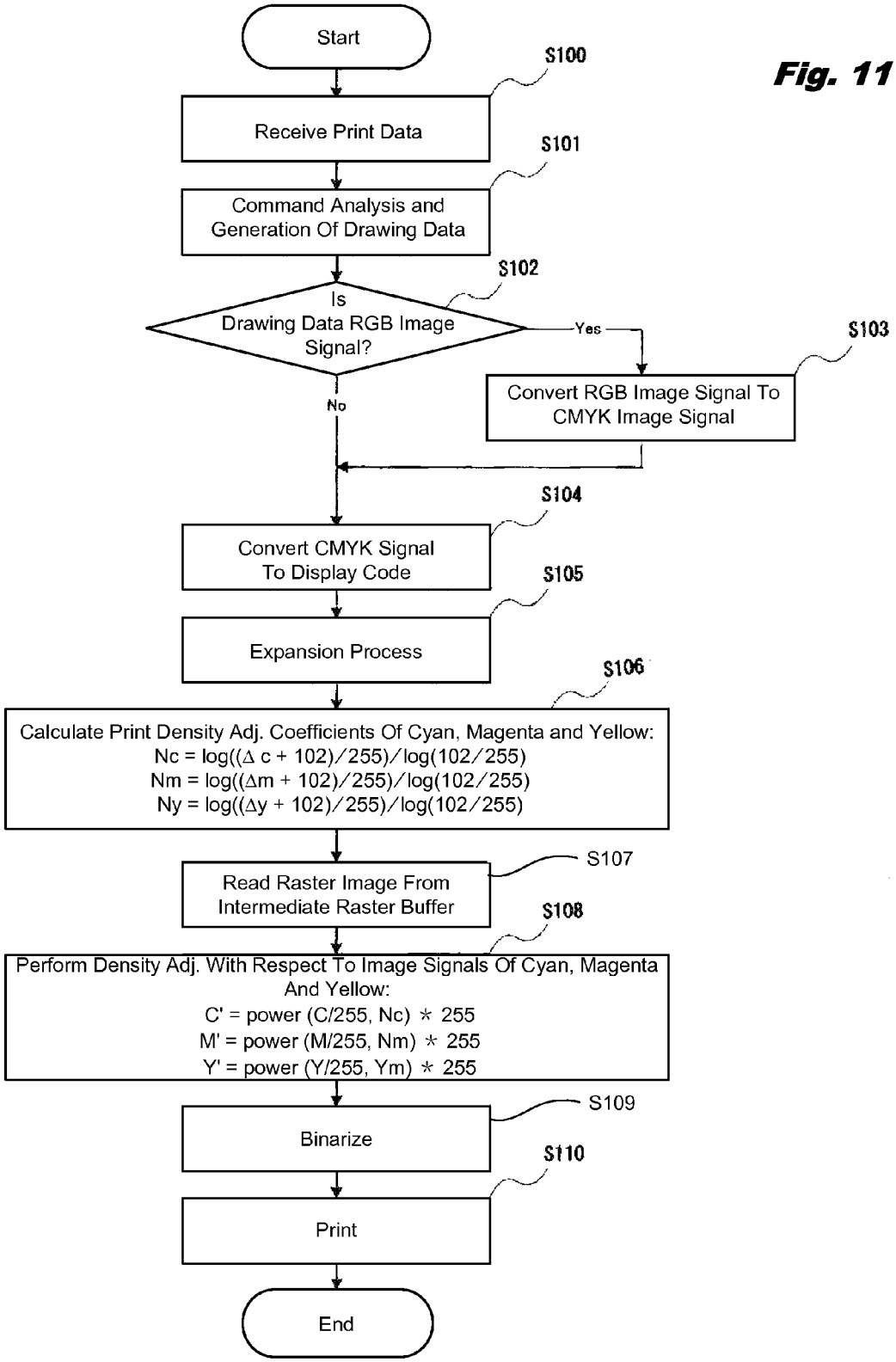
FIG. 11 illustrates a flow diagram illustrating operations when printing is performed in the printer according to the first embodiment.

First, an operation when printing is performed in the printer 1 is described using the flow diagram of FIG. 11.

First, the print data receiver 201 receives print data from outside, and temporarily stores the received print data in the print data buffer 202 (S100).

Next, the editing processor 203 reads the print data from the print data buffer 202, performs command analysis for each page, and generates drawing data (S101). Format of an image signal of the drawing data is confirmed (S102). When the format of the image signal of the drawing data is that of an RGB image signal, the editing processor 203 converts the drawing data to a CMYK image signal and holds the CMYK image signal (S103). When the format of the image signal of the drawing data is that of a CMYK image signal, the editing processor 203 holds the CMYK image signal.

Next, the editing processor 203 converts the held CMYK image signal into a display code and stores the display code in the page buffer 204 (S104).

Next, the expansion processor 205 reads display codes of one page from the page buffer 204, converts print content of the entire page into a raster image, and stores the raster image in the intermediate raster buffer 206 (S105).

Next, the image signal converter 207, initially, inputs print density adjustment amounts of cyan, magenta and yellow from the print density adjustment amount holding part 302, and performs calculation of the print density adjustment coefficients (applying the above formulas (1)-(3)) (S106). Next, the image signal converter 207 reads the raster image of the CMYK image signals from the intermediate raster buffer 206 (S107), and performs density adjustment with respect to the image signals of cyan, magenta and yellow (applying the above formulas (4)-(6)) (S108).

Finally, conversion into 1-bit CMYK image signal values that can be developed by the printer engine 100 is performed, and the 1-bit CMYK image signal values are stored in the raster buffer 208 (S109).

The printer engine controller 300 reads a raster image of one page from the raster buffer 208, and causes the printer engine 100 to operate to perform printing of the input raster image (S110).

Figure 12:
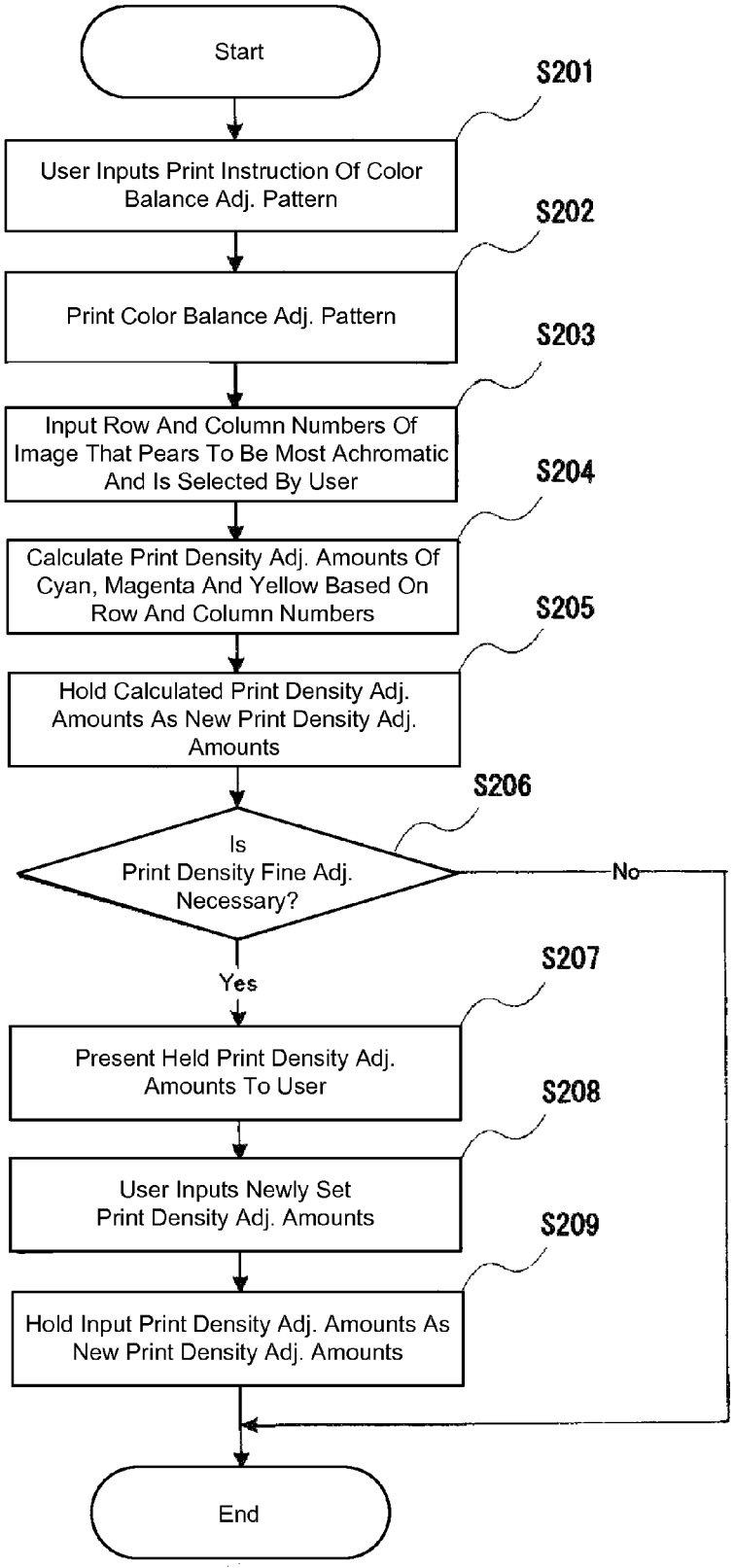
FIG. 12 illustrates a flow diagram illustrating operations when print density adjustment is performed in the printer according to the first embodiment.

Next, a density adjustment process that the print density adjustment management part 210 performs is described using the flow diagram of FIG. 12.

In the print density adjustment management part 210, in the print density adjustment process, printing of the color balance adjustment pattern, print density adjustment, and print density fine adjustment are performed in this order.

First, in an operation of the user (operation with respect to the operation panel 209), the print density adjustment management part 210 causes the color balance adjustment pattern print reception screen to be displayed on the operation panel 209 (display 209*a*), and a print instruction is made (the "YES" button is pressed) by the user (S201).

When the print instruction is made by the user, the print density adjustment management part 210 reads the color balance adjustment pattern from the color balance adjustment pattern storing part 301, and starts a print process of the color balance adjustment pattern by supplying the color balance adjustment pattern to the editing processor 203 (S202). A print process flow of the color balance adjustment pattern is the same as that with respect to the print data that is received from outside in the above-described FIG. 11 and thus a detailed description thereof is omitted.

Next, the print density adjustment management part 210 displays the sample image selection screen on the display 209*a* of the operation panel 209, and receives from the user an input of an image number of a color sample image SCP (an image number of an image that appears to be most achromatic and is selected by the user viewing the color balance adjustment sheet) (S203).

Next, the print density adjustment management part 210, based on the image number input at S203, calculates respective print density adjustment amounts of cyan, magenta and yellow (S204), and holds the calculated print density adjustment amounts in the print density adjustment amount holding part 302 (S205).

Next, the print density adjustment management part 210 receives from the user an input of whether or not fine adjustment is necessary with respect to the print density adjustment amounts (S206). For example, by using an operation screen in which a message such as "Do you want to perform print density adjustment amount fine adjustment?" and buttons (a button on which "YES" is displayed and a button on which "NO" is displayed) that allow selection of whether or not fine adjustment is necessary are arranged, when the print density adjustment management part 210 receives from the user an input indicating that fine adjustment with respect to the print density adjustment amounts is not necessary (for example, when the button on which "NO" is displayed is pressed in the above-described operation screen), the print density adjustment management part 210 may terminate the print density adjustment process.

On the other hand, when the print density adjustment management part 210 receives from the user an input indicating that fine adjustment with respect to the print density adjustment amounts is necessary (for example, when the button on which "YES" is displayed is pressed in the above-described operation screen), the print density adjustment management part 210 operates from a process of S207 (to be described later) to perform print density fine adjustment. Specifically, the print density adjustment amount fine adjusting part 305 displays the print density fine adjustment screen, and further displays, in fields of respective values of cyan, magenta and yellow of the print density fine adjustment screen, values of the print density adjustment amounts that are stored in the print density adjustment amount holding part 302 (S207).

Next, the print density adjustment amount fine adjusting part 305 receives fine adjustments (update inputs) with respect to the print density adjustment amounts of the respective colors using the print density fine adjustment screen (S208).

Next, based on the input values, the print density adjustment amount fine adjusting part 305 calculates the print density adjustment amounts, and holds the print density adjustment amounts in the print density adjustment amount holding part 302 (S209). As a result, the print density adjustment process by the print density adjustment management part 210 ends.

Thereafter, when print data received from outside is printed, in the image signal converter 207, the print density adjustment amounts that are held at S205 or S209 are referenced.

Figure 13:
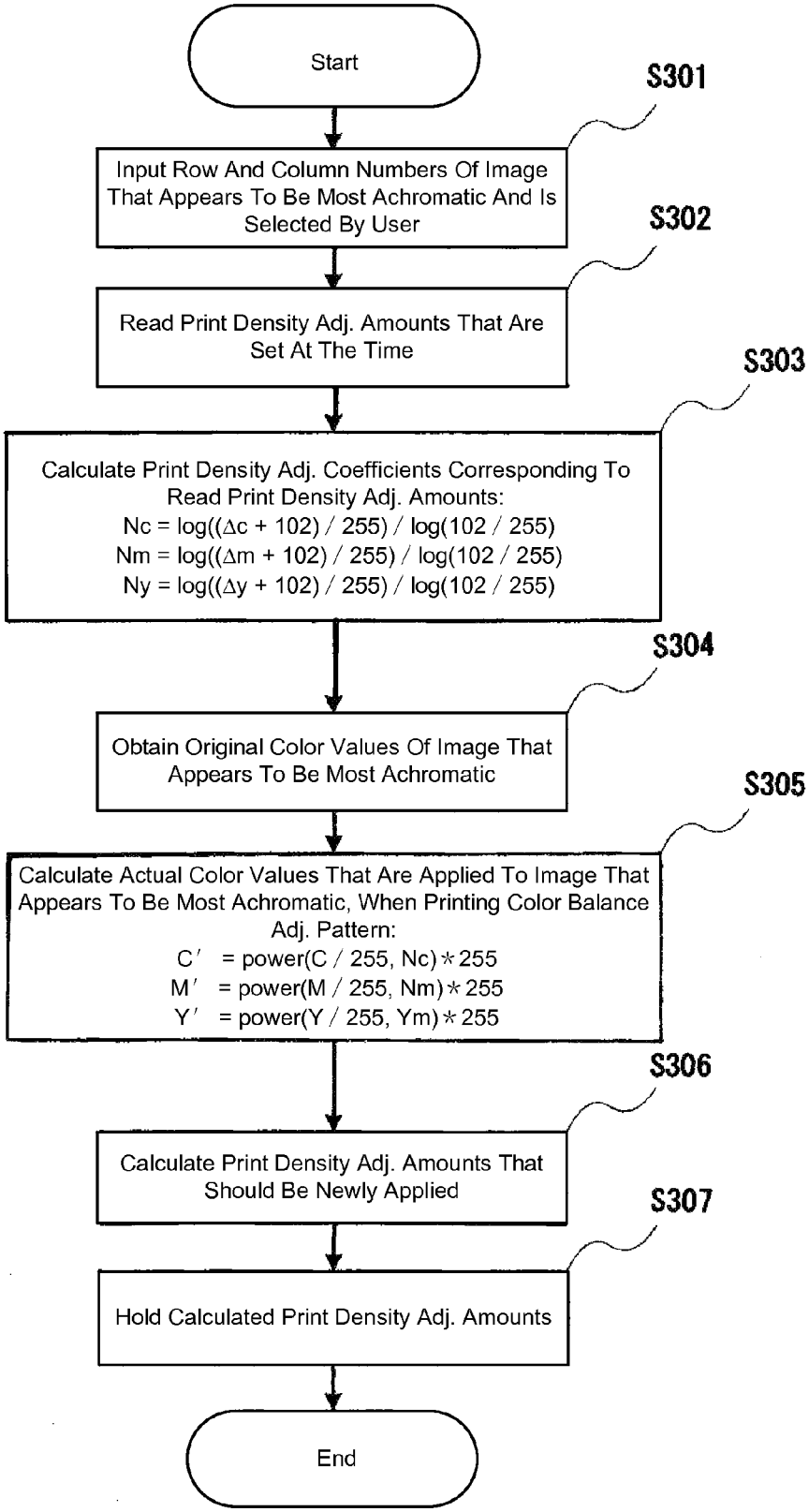
FIG. 13 illustrates a flow diagram illustrating operations of the print density adjustment management part of the first embodiment.

Next, details of a calculation process of the print density adjustment amounts in the print density adjustment management part 210 (a process of the above-described S209) are described using the flow diagram of FIG. 13.

First, the print density adjustment amount determination part 303 obtains the image number that is input (selected) by the user using the sample image selection screen of the above-described S204 (S301).

Next, the print density adjustment amount determination part 303 reads from the print density adjustment amount holding part 302 the print density adjustment amounts (the respective print density adjustment amounts of cyan, magenta and yellow) that are set at the time (S302).

Next, based on the print density adjustment amounts that are read at the above-described S302, the print density adjustment amount determination part 303 calculates (for example, using the above formulas (1) -(3)) the print density adjustment coefficients Nc, Nm and Ny that are applied when the color balance adjustment pattern is printed (when printing is performed at above-described S202) (S303).

Next, based on the image number that is obtained at the above-described S301 and the color values that are set to the color balance adjustment pattern of the color balance adjustment pattern storing part 301, the print density adjustment amount determination part 303 obtains the original color values (the color values before the print density adjustment is performed) of the color sample image SCP that is selected by the user at the above-described S204 (the color sample image SCP that is selected by the user as the one that appears to be most achromatic) (S304).

Next, based on the print density adjustment coefficients that are calculated at the above-described S303, the print density adjustment amount determination part 303 calculates (for example, by applying the above formulas (4)-(6)) the actual color values C', M', Y' that are applied to the color sample image SCP that is selected by the user at above-described S204 when the color balance adjustment pattern is printed (when printing is performed at the above-described S202) (S305).

Next, by subtracting the color values of the reference image BCP from the color values C', M', Y' that are calculated at S305, the print density adjustment amount determination part 303 calculates the print density adjustment amounts that should be newly applied (S306).

Finally, the print density adjustment amount determination part 303 holds, in the print density adjustment amount holding part 302, the print density adjustment amounts that are calculated at S306 and that should be newly applied (S307).

(A-3) Effects of First Embodiment

According to the first embodiment, the following effects can be achieved.

In the printer 1, due to the color balance adjustment pattern output function, the color balance adjustment pattern containing the target images TP (black monochromatic images), the reference image BCP (CMY gray mixed color image for which CMY colors, each at a predetermined density, are mixed) and the plurality of the color sample images SCP (CMY gray mixed color images of which densities of the CMY colors are each modified for a predetermined amount with respect to the reference image BCP) is printed on the print sheet P. Further, in the printer 1, due to the print density adjustment amount determination function, the user is allowed to select the color sample image SCP that appears to be most achromatic (the color sample image SCP that best matches the target image TP in appearance), and the print density adjustment amounts based on the selected color sample image SCP are held. Further, in the printer 1, due to the print density fine adjustment function, the held print density adjustment amounts are presented to the user and fine adjustments (updates) with respect to the held print density adjustment amounts can be received from the user. The printer 1 is configured in the manner that the print density adjustment amounts determined by the print density adjustment amount determination function are adjusted by the print density fine adjustment function. Therefore, an effect is achieved that a more gray-balanced image (an image that appears to be more gray-balanced to the user) is reproduced.

Further, printer 1 is configured in the manner that the print density adjustment amounts determined by the print density adjustment amount determination function are adjusted by the print density fine adjustment function. Therefore, as compared to a case where the print density adjustment amounts and the print density fine adjustment function are realized as independent functions, since it does not occur that one adjustment cancels out an adjustment result of the other adjustment, an effect is achieved that adjustments can be performed as intended by the user.

(B) Second Embodiment

In the following, with reference to the drawings, a second embodiment is described in which the image forming apparatus and the control program according to the present invention are applied to a printer.

(B-1) Configuration of Second Embodiment

A hardware configuration and an overall functional configuration of a printer 1A of the second embodiment can be described using the same drawings (FIGS. 1-4) as the first embodiment. In the following, with respect to the second embodiment, only differences as compared to the first embodiment are described.

The printer 1A of the second embodiment is different from the first embodiment in that the image signal converter 207 and the print density adjustment management part 210 are replaced by an image signal converter 207A and a print density adjustment management part 210A.

FIG. 14 illustrates a functional configuration of the print density adjustment management part 210A of the second embodiment. In FIG. 14, a part that is the same as or corresponding to a part in the above-described FIG. 1 is indicated using the same or corresponding reference numeral symbol.

The print density adjustment management part 210A of the second embodiment is different from the first embodiment in that, not only density adjustment for color (CMY) toner agents is performed, but density adjustment for black (K) toner agent alone is also performed.

As illustrated in FIG. 14, the print density adjustment management part 210A of the second embodiment is different from the first embodiment in that a black print density adjustment amount holding part 306 and a black print density adjustment amount adjusting part 307 are added that perform a process to adjust black (K) print density.

Further, in the print density adjustment management part 210A of the second embodiment, operation of the image signal converter 207A is different from the first embodiment. The image signal converter 207A reads a raster image of one page from the intermediate raster buffer 206, converts 8-bit image signal values of the respective CMYK colors into 1-bit image signal values of the respective CMYK colors that are printable by the printer engine, and stores the raster image after the conversion in the raster buffer 208. However, when the image signal converter 207A of the second embodiment reads the 8-bit image signal values of the respective CMYK colors, the image signal converter 207A inputs the print density adjustment amounts of the respective cyan, magenta, yellow and black colors that are stored in the print density adjustment management part 210, and converts the image signal values of C, M, Y and K based on the print density adjustment amounts.

The black print density adjustment amount holding part 306 has a function of holding the black print density adjustment amount. In this embodiment, the black print density adjustment amount holding part 306 holds, as a "black print density adjustment amount", an increase or decrease amount of a color value with respect to a color value of black of the target image TP that is arranged in the color balance adjustment pattern and that is represented with a black monochromatic color. In the following the black print density adjustment amount is represented using Δk.

Figure 15:
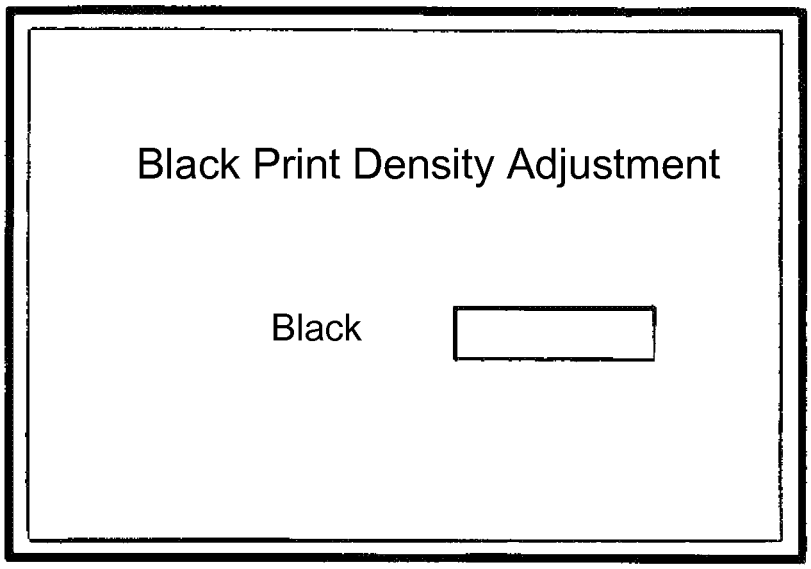
FIG. 15 illustrates explanatory diagram illustrating a configuration example of a black print density adjustment screen that is displayed on the printer according to the second embodiment.
Figure 16A:
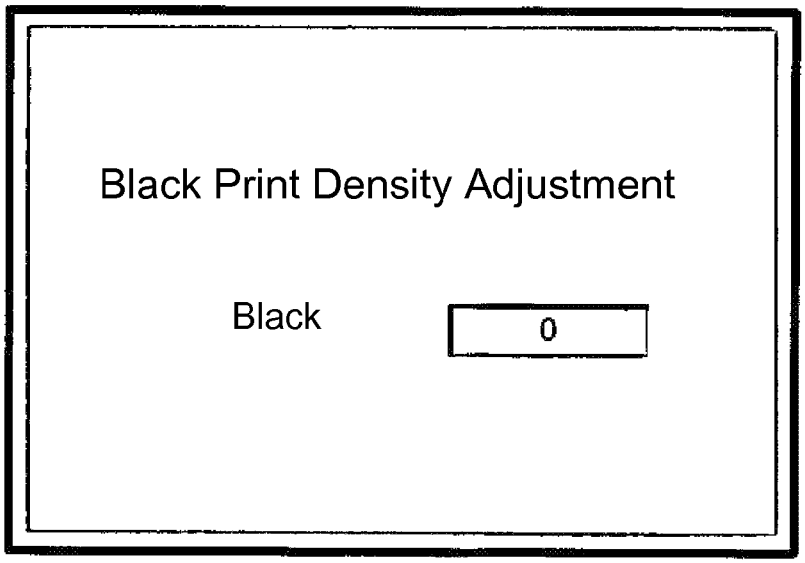
FIGS. 16A and 16B illustrate explanatory diagrams illustrating transition of the black print density adjustment screen that is displayed on the printer according to the second embodiment.
Figure 16B:
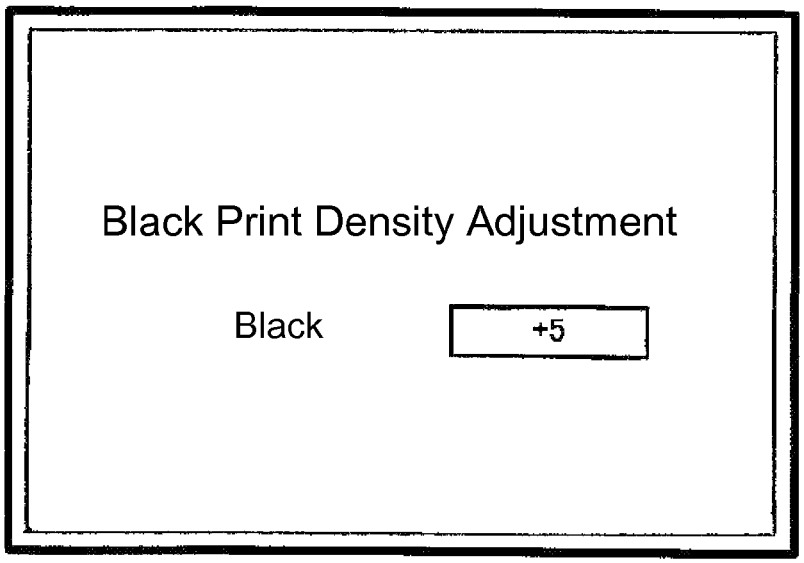

In response to an operation of the user, the black print density adjustment amount adjusting part 307 receives adjustment (update) with respect to the black print density adjustment amount that is held in the black print density adjustment amount holding part 306. Specifically, the black print density adjustment amount adjusting part 307 displays the black print density adjustment amount that is held by the black print density adjustment amount holding part 306 at the time, and displays, on the operation panel 209 (display 209*a*), an operation screen (hereinafter, referred to as a "black print density adjustment screen") that allows the black print density adjustment amount to be adjusted. As the sample image selection screen, for example, as illustrated in FIGS. 15, 16A and 16B, a screen can be applied in which a black print density adjustment amount is displayed and a field that allows the displayed black print density adjustment amount to be modified (allows the value to be modified) is arranged. Further, FIG. 16A illustrates a state in which the black print density adjustment amount that is held in the black print density adjustment amount holding part 306 is Δk=0. Further, FIG. 16B illustrates a state in which the black print density adjustment amount is modified to be Δk=+5.

Next, an adjustment method of the black print density when the printer 1A (the print density adjustment management part 210A) prints print data that contains the color balance adjustment pattern is described.

The black print density adjustment in the image signal converter 207A of the second embodiment is performed using a "power function" that is the same as for cyan, magenta and yellow. Therefore, in the image signal converter 207A, based on the black print density adjustment amount that is set in the black print density adjustment amount holding part 306 at the time, an "exponent" that is applied to the print density adjustment is calculated.

When the "exponent" that is applied to the black print density adjustment is Nk, the "exponent" is calculated using the following formula (13).

$$Nk=\log((\Delta k+128)/255)/\log(128/255) \quad (13)$$

The number "128" in the above formula (13) is a color value of black that is set for the target image TP (a color value before the print density adjustment). Further, Δk is the black print density adjustment amount that is held in the black print density adjustment amount holding part 306 at the time. For example, when the black print density adjustment amount that is held in the black print density adjustment amount holding part 306 is Δk=+5, the exponent is Nk=0.944. That is, a color value of an image that is printed at the time is converted in the image signal converter 207A using the following formula (14).

$$K'=\mathrm{power}(K/255,Nk)*255 \quad (14)$$

Specifically, in the print density adjustment management part 210A, in a situation where Δk=+5 is set, when the color balance adjustment pattern is printed, the color value of the target image TP that is actually printed is a value illustrated by the following formula (15).

$$K'=\mathrm{power}(128/255,0.944)=133 \quad (15)$$

In this state, when the print density adjustment management part 210A performs a color balance adjustment process, a state is reproduced in which the target image TP of the color balance adjustment sheet is darker than a standard. Therefore, as a result, the color values of cyan, magenta and yellow of the color sample image SCP that is selected at the time are large values as compared to a color balance adjustment sheet in a case of standard (case where Δk=0). That is, in the print density adjustment management part 210A, the respective print density adjustment amounts of cyan, magenta and yellow are also set to values in directions darker than the case of standard. On the other hand, in the print density adjustment management part 210A, when Δk is set to a minus value, the respective print density adjustment amounts of cyan, magenta and yellow are set to values in directions lighter than the case of standard.

In the printer 1A of the second embodiment, by the print density adjustment management part 210A (the black print density adjustment amount holding part 306 and the black print density adjustment amount adjusting part 307), a black image formation density adjustment amount holding part is configured. Further, in the printer 1A, the black print density adjustment amount adjusting part 307 also functions as a black image formation density adjustment amount modifying part.

(B-2) Operation of Second Embodiment

Next, an operation of the printer 1A of the second embodiment having the above configuration is described.

(B-2-1) Operation of Printer 1A at Time of Printing

First, an operation when printing is performed in the printer 1A is described using the flow diagram of FIG. 17. In FIG. 17, an operation that is the same as in the above-described FIG. 11 is indicated using the same step number (reference numeral symbol).

The printer 1A of the second embodiment is different from the first embodiment in that processes of S401 and S402 are added.

The image signal converter 207A of the second embodiment is different from the first embodiment in that, when the print density adjustment coefficients Nc, Nm and Ny of cyan, magenta and yellow are obtained by the process of the above-described S106, the print density adjustment coefficient Nk of black is also obtained at S401 (for example, using the above formula (13)).

Further, image signal converter 207A of the second embodiment is different from the first embodiment in that, when density adjustment is performed with respect to image signals of cyan, magenta and yellow by the process of the above-described S108, a density adjustment value with respect to an image signal of black is calculated by a process of S402 (for example, using the above formula (14)).

Then, the image signal converter 207A of the second embodiment converts, at the above-described S109, the converted CMYK image signals into 1-bit CMYK image signal values that can be developed by the printer engine 100, stores the 1-bit CMYK image signal values in the raster buffer 208, and causes the printer engine 100 to execute a printing operation.

Figure 18:
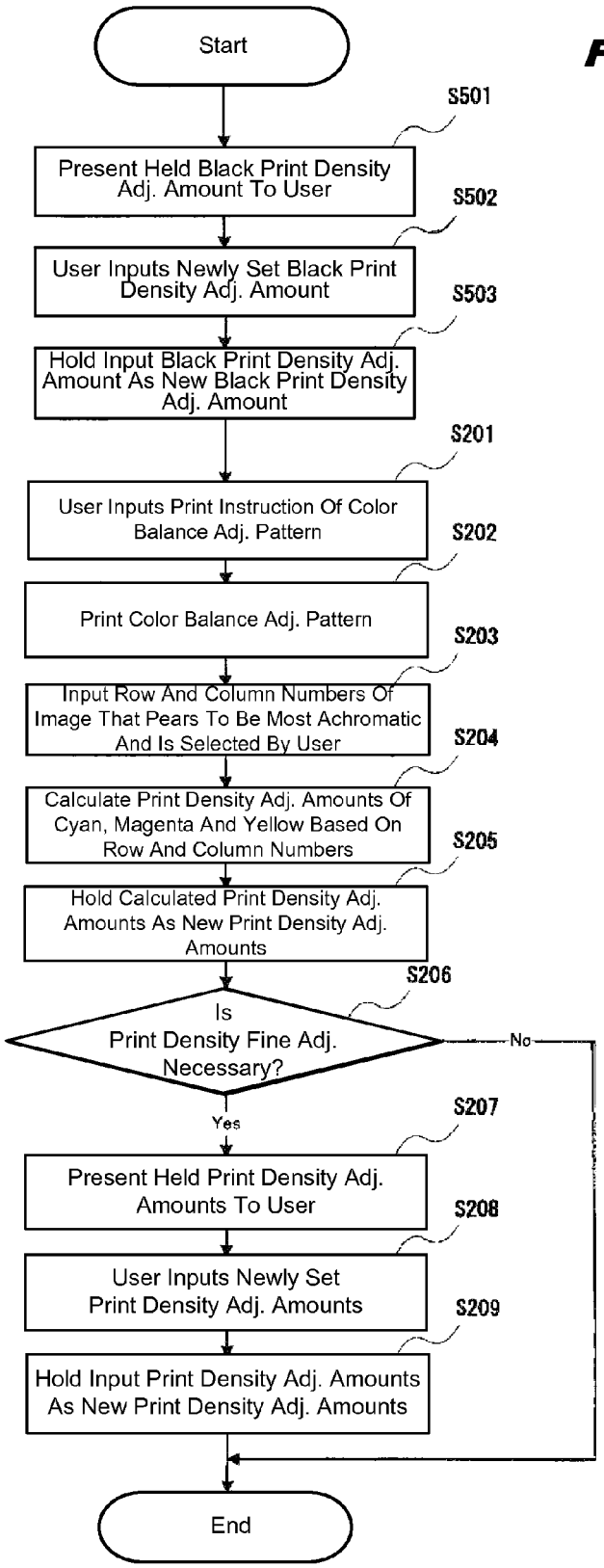
FIG. 18 illustrates a flow diagram illustrating operations when print density adjustment is performed in the printer according to the second embodiment.

Next, a density adjustment process that the print density adjustment management part 210A performs is described using the flow diagram of FIG. 18. In FIG. 18, an operation that is the same as in the above-described FIG. 12 is indicated using the same step number (reference numeral symbol).

The print density adjustment management part 210A of the second embodiment is different from the first embodiment in that a black print density adjustment process (process of S501-S503) is added. In FIG. 18, the process of S501-S503 is arranged at beginning of the flow diagram (at a timing prior to S201).

When the black print density adjustment process is started, the print density adjustment management part 210A (black print density adjustment amount adjusting part 307) first displays a black print density adjustment screen on the operation panel 209 (display 209*a*) (S501) to present to the user the black print density adjustment amount that is held by the black print density adjustment amount holding part 306, and receives an update with respect to the black print density adjustment amount (S502). For example, when the black print density adjustment amount that is initially held by the black print density adjustment amount holding part 306 is $\Delta k=0$, an initial state of the black print density adjustment screen is as illustrated in FIG. 16A. When the black print density adjustment amount is updated by the user to be +5, the initial state of the black print density adjustment screen becomes as illustrated in FIG. 16B.

When the value of the black print density adjustment amount is modified on the black print density adjustment screen, the black print density adjustment amount adjusting part 307 holds the value in the black print density adjustment amount holding part 306 (S503). In this case, when the print density adjustment amount is not modified on the black print density adjustment screen, the black print density adjustment amount adjusting part 307 does not perform modification of $\Delta k$.

Thereafter, when print data received from outside is printed in the printer 1A, in the image signal converter 207A, the black print density adjustment amount that is held at S503 is referenced.

(B-3) Effects of Second Embodiment

According to the second embodiment, the following effects can be achieved.

In the printer 1A of the second embodiment, a configuration in which the black print density is adjusted is added. Therefore, when the print density adjustment operation is performed using the color balance adjustment sheet, darkness of the black monochromatic color that forms the target image TP can be modified. That is, in the printer 1A of the second embodiment, before the print density adjustment operation (process starting from the above-described S201) is performed using the color balance adjustment sheet, the black print density adjustment amount is adjusted (the process of the above-described S501-S503 is executed). As a result, in the printer 1A of the second embodiment, when the print density adjustment operation is performed using the color adjustment sheet, without receiving an explicit specification from the user, cyan, magenta and yellow densities can be automatically adjusted in directions darker or lighter than the standard and a color balance that matches user's intention can be realized.

(C) Third Embodiment

In the following, with reference to the drawings, a third embodiment is described in which the image forming apparatus and the control program according to the present invention are applied to a printer.

(C-1) Configuration of Third Embodiment

A hardware configuration and an overall functional configuration of a printer 1B of the third embodiment can be described using the same drawings (FIGS. 1-4) as the first embodiment. In the following, with respect to the third embodiment, differences as compared to the first embodiment are mainly described.

The printer 1B of the third embodiment is different from the first embodiment in that the print density adjustment management part 210 is replaced by a print density adjustment management part 210B. The print density adjustment management part 210B of the third embodiment is different from the first embodiment in that density adjustment is performed in accordance with print density of a region where printing is performed. The print density adjustment management part 210B of this embodiment is described as an example as that in which different print density adjustment is performed for each of print density regions of three levels (a low density region, an intermediate density region and a high density region). Further, along with this, the third embodiment is different from the first embodiment in that the image signal converter 207 is replaced by an image signal converter 207B.

Figure 19:
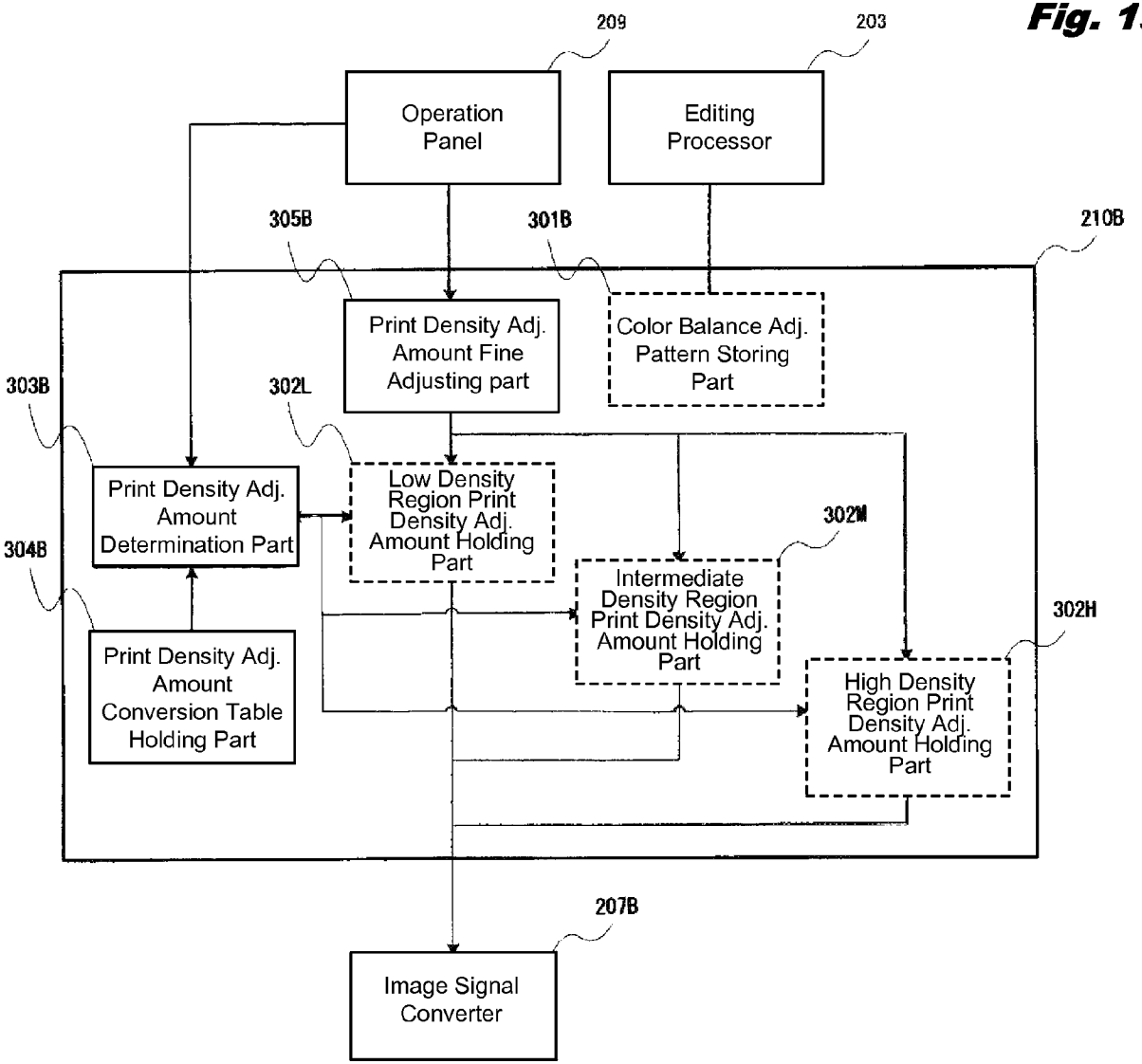
FIG. 19 illustrates a block diagram illustrating a functional configuration of a print density adjustment management part that configures a printer according to a third embodiment.

A functional configuration of the print density adjustment management part 210B of the third embodiment is described using FIG. 19.

In the print density adjustment management part 210B of the third embodiment, the color balance adjustment pattern storing part 301, the print density adjustment amount determination part 303, the print density adjustment amount conversion table holding part 304 and the print density adjustment amount fine adjusting part 305 are replaced by a color balance adjustment pattern storing part 301B, a print density adjustment amount determination part 303B, a print density adjustment amount conversion table holding part 304B and a print density adjustment amount fine adjusting part 305B. Further, the print density adjustment management part 210B of the third embodiment is different in that the print density adjustment amount holding part 302 of the first embodiment is replaced by print density adjustment amount holding parts (a low density region print density adjustment amount holding part 302L, an intermediate density region print density adjustment amount holding part 302M and a high density region print density adjustment amount holding part 302H) of the respective print density regions of three levels (the low density region, the intermediate density region and the high density region).

As described above, in the print density adjustment management part 210B of the third embodiment, different print density adjustment is performed for each of the print densities of three levels (the low density region, the intermediate density region and the high density region). Therefore, in the print density adjustment management part 210B, in the color balance adjustment pattern storing part 301B, a color balance adjustment pattern is stored for each of the print densities. In the following, the color balance adjustment pattern of the low density is referred to as a "color balance adjustment pattern CBP-L", the color balance adjustment pattern of the intermediate density is referred to as a "color balance adjustment pattern CBP-M", and the color balance adjustment pattern of the high density is referred to as a "color balance adjustment pattern CBP-H."

Figure 20:
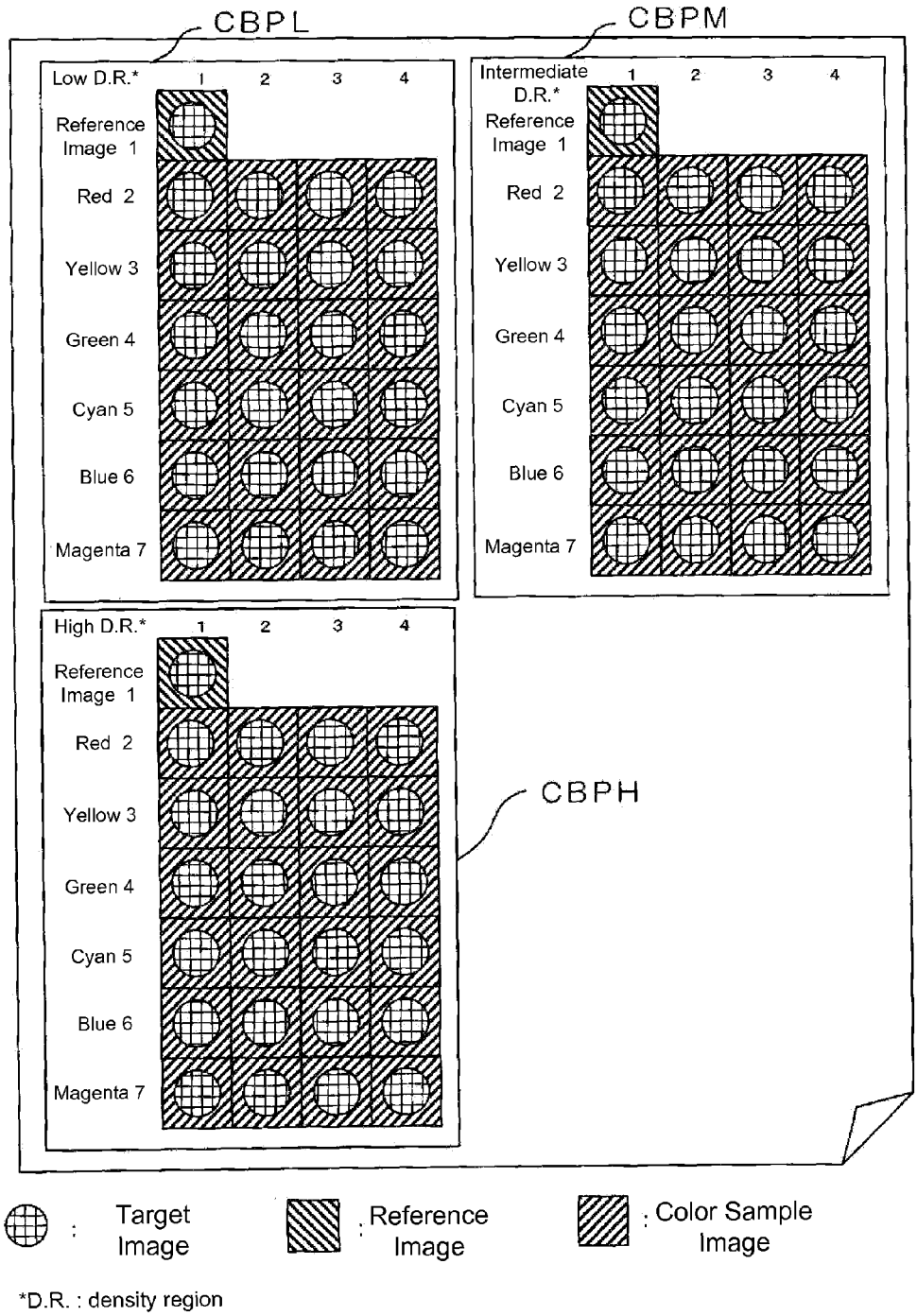
FIG. 20 illustrates an explanatory diagram illustrating a configuration example of a color balance adjustment pattern (color balance adjustment sheet) that is applied in the print density adjustment management part of the third embodiment.

FIG. 20 illustrates a plan view of a color balance adjustment sheet that is obtained by printing three color balance adjustment patterns CBP-L, CBP-M, CBP-H on the print sheet P. A basic configuration of each of the color balance adjustment patterns CBP-L, CBP-M, CBP-H is the same as the color balance adjustment pattern (above-described FIG. 6) of the first embodiment and thus a detailed description thereof is omitted. The color balance adjustment patterns CBP-L, CBP-M, CBP-H are patterns configured by color images based on parameters that are respectively optimized by print density adjustments of the low density region, the intermediate density region and the high density region.

Specifically, for example, as color values of the reference images BCP and the color sample images SCP that configure the respective color balance adjustment patterns CBP-L, CBP-M, CBP-H, values of tables illustrated in FIG. 21 can be applied. FIGS. 21A-21C respectively illustrate color values of the reference images BCP and the color sample images SCP that configure the respective color balance adjustment patterns CBP-L, CBP-M, CBP-H. A configuration of each of the tables of FIGS. 21A-21C is the same as the example of the first embodiment (the above-described FIG. 6) and thus a detailed description thereof is omitted.

Further, this embodiment is described as that in which, for the target images TP that respectively configure the color balance adjustment patterns CBP-L, CBP-M, CBP-H, a 25% print density ((C, M, Y, K)=(0, 0, 0, 64)), a 50% print density ((C, M, Y, K)=(0, 0, 0, 64)) and a 75% print density ((C, M, Y, K)=(0, 0, 0, 192)) of black monochromatic color are respectively applied.

Further, this embodiment is described as that in which, for the reference images BCP that configure the color balance adjustment patterns CBP-L, CBP-M, CBP-H, values of (C, M, Y, K)=(51, 51, 51, 0), (C, M, Y, K)=(102, 102, 102, 0) and (C, M, Y, K)=(153, 153, 153, 0) are respectively set.

Further, the respective color balance adjustment patterns CBP-L, CBP-M, CBP-H of this embodiment are each described as that in which the shift amount of each of the color sample images SCP (shift amount of hue of each column) with respect to the reference image BCP is a value the same as that of the first embodiment.

As described above, the color balance adjustment pattern storing part 301B stores the color balance adjustment patterns illustrated in FIG. 20 (to which the color values of FIG. 21 are applied), and, based on an operation of the user (operation of the color balance adjustment pattern print reception screen), the color balance adjustment patterns are supplied to the editing processor 203 and printing is performed.

The print density adjustment amount conversion table holding part 304B holds the color values (the respective color values of cyan, magenta and yellow) of the respective kinds of images (including the reference images BCP and the color sample images SCP) that are arranged in the color balance adjustment patterns CBP-L, CBP-M, CBP-H (for example, holds table information as illustrated in FIGS. 21A-21C as print density adjustment amount conversion tables).

The low density region print density adjustment amount holding part 302L, the intermediate density region print density adjustment amount holding part 302M and the high density region print density adjustment amount holding part 302H respectively hold print density adjustment amounts (in the example of this embodiment, increase or decrease amounts of color values with respective to the respective color values of cyan, magenta and yellow) corresponding to the low density region, the intermediate density region and the high density region. In the following, the print density adjustment amounts of cyan, magenta and yellow that are held by the low density region print density adjustment amount holding part 302L are respectively represented using ΔLc, ΔLm and ΔLy. Further, in the following, the print density adjustment amounts of cyan, magenta and yellow that are held by the intermediate density region print density adjustment amount holding part 302M are respectively represented using ΔMc, ΔMm and ΔMy. Further, in the following, the print density adjustment amounts of cyan, magenta and yellow that are held by the high density region print density adjustment amount holding part 302H are respectively represented using ΔHc, ΔHm and ΔHy.

The print density adjustment amount determination part 303B of the third embodiment is different from the first embodiment in that, as the sample image selection screen, a screen of a configuration in which inputs of numbers (a row number and a column number) of an image for each of the low density region, the intermediate density region and the high density region are received is presented (output) to the user.

As the sample image selection screen of the third embodiment, for example, as illustrated in FIG. 22, a screen can be applied in which a message such as that "Please specify the numbers of the images that appear to be most achromatic in the color balance adjustment sheet" and fields that can receive inputs of numbers (a row number and a column number) of an image for each of the low density region, the intermediate density region and the high density region are arranged. The print density adjustment amount determination part 303B obtains from the print density adjustment amount conversion table holding part 304B the color values (color values of the respective density regions) according to the image numbers that are selected using the sample image selection screen that is displayed by the print density adjustment amount determination function, calculates print density adjustment amounts corresponding to the respective density regions, and stores the print density adjustment amounts in the print density adjustment amount holding parts (the low density region print density adjustment amount holding part 302L, the intermediate density region print density adjustment amount holding part 302M and the high density region print density adjustment amount holding part 302H) that correspond to the respective density regions.

The print density adjustment amount fine adjusting part 305B of the third embodiment is different from the first embodiment in that the print density fine adjustment screen is configured to allow fine adjustment (update) of print density adjustment amounts to be performed with respect to each of the low density region, the intermediate density region and the high density region.

As the print density fine adjustment screen of the third embodiment, for example, as illustrated in FIG. 23, a screen can be applied in which input fields are arranged that allow print density adjustment amounts of cyan, magenta and yellow to be fine adjusted (updated) with respect to each of the low density region, the intermediate density region and the high density region. The print density adjustment amount fine adjusting part 305B holds the print density adjustment amounts that are fine adjusted (updated) using the print density fine adjustment screen in the print density adjustment amount holding parts (the low density region print density adjustment amount holding part 302L, the intermediate density region print density adjustment amount holding part 302M and the high density region print density adjustment amount holding part 302H) that correspond to the respective density regions.

FIGS. 24A-24C illustrate explanatory diagrams illustrating transition of the print density fine adjustment screen. For example, when the print density adjustment amounts of cyan, magenta and yellow that are held in the low density region print density adjustment amount holding part 302L, the intermediate density region print density adjustment amount holding part 302M and the high density region print density adjustment amount holding part 302H are respectively (−5, +10, +5), (+5, −10, −5), (−5, +10, +5), content of the print density fine adjustment screen is as displayed in FIG. 24A.

Next, details of a print density adjustment process (print density adjustment process based on the print density adjustment amounts held by the print density adjustment management part 210B) by the image signal converter 207B are described.

The print density adjustment in the image signal converter 207B of the third embodiment is performed using interpolation calculation in which the respective print density adjustment amounts and input color values for the respective density regions (the low density region, the intermediate density region and the high density region) are used as coefficients. When color values of cyan, magenta and yellow of each pixel that is input to the image signal converter 207B are C, M and Y, formulas (hereinafter, also referred to as "print density adjustment formulas") for obtaining print density adjustment amounts f(C), f(M) and f(Y) that are applied to the respective color values C, M and Y in the image signal converter 207B can be expressed, for example, by the following formulas (16)-(27). In the following formulas (16)-(27), "51", "102" and "153" are respectively color values of the respective colors (cyan, magenta and yellow) that are set for the reference image BCP of the low density region, the reference image BCP of the intermediate density region and the reference image BCP of the high density region.

In the image signal converter 207B, the print density adjustment amount f(C) of cyan after the print density adjustment is calculated by applying one of the following formulas (16)-(19) according to an input value of the color value C of cyan. Further, in the image signal converter 207B, the print density adjustment amount f(M) of magenta after the print density adjustment is calculated by applying one of the following formulas (20)-(23) according to an input value of the color value M of magenta. Further, in the image signal converter 207B, the print density adjustment amount f(Y) of yellow after the print density adjustment is calculated by applying one of the following formulas (24)-(27) according to an input value of the color value Y of yellow.

[For 0≤C≤51]

$$f(C)=(C/51)*\Delta Lc \tag{16}$$

[For 51≤C≤102]

$$f(C)=(1-(C-51)/51)*\Delta Lc+((C-51)/51)*\Delta Mc \tag{17}$$

[For 102≤C≤153]

$$f(C)=(1-(C-102)/51)*\Delta Mc+((C-102)/51)*\Delta Hc \tag{18}$$

[For 153≤C≤255]

$$f(C)=(1-(C-153)/102)*\Delta Hc \tag{19}$$

[For 0≤M≤51]

$$f(M)=(M/51)*\Delta Lm \tag{20}$$

[For 51≤M≤102]

$$f(M)=(1-(M-51)/51)*\Delta Lm+((M-51)/51)*\Delta Mm \tag{21}$$

[For 102≤M≤153]

$$f(M)=(1-(M-102)/51)*\Delta Mm+((M-102)/51)*\Delta Hm \tag{22}$$

[For 153≤M≤255]

$$f(M)=(1-(M-153)/102)*\Delta Hm \tag{23}$$

[For 0≤Y≤51]

$$f(Y)=(Y/51)*\Delta Ly \tag{24}$$

[For 51≤Y≤102]

$$f(Y)=(1-(Y-51)/51)*\Delta Ly+((Y-51)/51)*\Delta My \tag{25}$$

[For 102≤Y≤153]

$$f(Y)=(1-(Y-102)/51)*\Delta My+((Y-102)/51)*\Delta Hy \tag{26}$$

[For 153≤Y≤255]

$$f(Y)=(1-(Y-153)/102)*\Delta Hy \tag{27}$$

For example, when the respective print density adjustment amounts of cyan, magenta and yellow that are held in the low density region print density adjustment amount holding part 302L are ΔLc=−5, ΔLm=+10 and ΔLy=+5, the respective print density adjustment amounts of cyan, magenta and yellow that are held in the intermediate density region print density adjustment amount holding part 302M are ΔMc=+5, ΔMm=−10 and ΔMy=−5, and the respective print density adjustment amounts of cyan, magenta and yellow that are held in the high density region print density adjustment amount holding part 302H are ΔHc=−5, ΔHm=+10 and ΔHy=+5, the color values of the image that is printed at the time are converted in the image signal converter 207 according to the following formulas (28)-(39).

In the image signal converter 207B, the color value C' of cyan after the print density adjustment is calculated as in one of the following formulas (28)-(31) according to the input value of the color value C of cyan. Further, in the image signal converter 207B, the color value M' of magenta after the print density adjustment is calculated as in one of the following formulas (32)-(35) according to the input value of the color value M of magenta. Further, in the image signal converter 207B, the color value Y' of yellow after the print density adjustment is calculated as in one of the following formulas (32)-(35) according to the input value of the color value Y of yellow.

[For 0≤C≤51]

$$C'=C+(C/51)*(-5) \tag{28}$$

[For 51≤C≤102]

$$C'=C+(1-(C-51)/51)*(-5)+((C-51)/51)*(+5) \tag{29}$$

[For 102≤C≤153]

$$C'=C+(1-(C-102)/51)*(+5)+((C-102)/51)*(-5) \tag{30}$$

[For 153≤C≤255]

$$C'=C+(1-(C-153)/102)*(-5) \tag{31}$$

[For 0≤M≤51]

$$M'=M+(M/51)*(+10) \tag{32}$$

[For 51≤M≤102]

$$M'=M+(1-(M-51)/51)*(+10)+((M-51)/51)*(-10) \tag{33}$$

[For 102≤M≤153]

$$M'=M+(1-(M-102)/51)*(-10)+((M-102)/51)*(+10) \tag{34}$$

[For 153≤M≤255]

$$M'=M+(1-(M-153)/102)*(+10) \tag{35}$$

[For 0≤Y≤51]

$$Y'=Y+(Y/51)*(+5) \tag{36}$$

[For 51≤Y≤102]

$$Y'=Y+(1-(y-51)/51)*(+5)+((Y-51)/51)*(-5) \tag{37}$$

[For 102≤Y≤153]

$$Y'=Y+(1-(Y-102)/51)*(-5)+((Y-102)/51)*(+5) \tag{38}$$

[For 153≤Y≤255]

$$Y'=Y+(1-(Y-153)/102)*(+5) \tag{39}$$

In this case, the image numbers the low density region, the intermediate density region and the high density region that are input using the sample image selection screen are respectively 51, 24 and 33. In this case, the color values of the respective images of the low density region, the intermediate density region and the high density region that appear to be most achromatic at the time are (C, M, Y, K)=(51, 41, 41, 0)

corresponding to the image number 51 of the color balance adjustment pattern CBP-L of the low density region, (C, M, Y, K)=(102, 112, 112, 0) corresponding to the image number 24 of the color balance adjustment pattern CBP-M of the intermediate density region, and (C, M, Y, K)=(153, 153, 158, 0) corresponding to the image number 33 of the color balance adjustment pattern CBP-H of the high density region. However, in the printer 1B, when the color values are printed, based on the print density adjustment amounts at the time, conversion of the color values is performed. Therefore, the respective color values of the low density region, the intermediate density region and the high density region that are actually printed are values of the following formulas (40)-(48).

[Color values of the low density region: C=51, M=41, Y=41]

$$C'=51+(51/51)*(-5)=46 \quad (40)$$

$$M'=41+(41/51)*(+10)=49 \quad (41)$$

$$Y'=41+(41/51)*(+5)=45 \quad (42)$$

[Color values of the intermediate density region: C=102, M=112, Y=112]

$$C'=51+(1-(102-51)/51)*(-5)+((102-51)/51)*(+5)=107 \quad (43)$$

$$M'=112+(1-(112-102)/51)*(+10)+((112-102)/51)*(-10)=106 \quad (44)$$

$$Y'=112+(1-(112-102)/51)*(-5)+((112-102)/51)*(+5)=109 \quad (45)$$

[Color values of the high density region: C=153, M=153, Y=158]

$$C'=153+(1-(153-102)/51)*(+5)+((153-102)/51)*(-5)=148 \quad (46)$$

$$M'=153+(1-(153-102)/51)*(+10)+((153-102)/51)*(-10)=163 \quad (47)$$

$$Y'=158+(1-(158-153)/102)*(+5)=163 \quad (48)$$

As described above, in the print density adjustment management part 210B, the original differences between the color values of the reference image BCP that appears to be most achromatic in each of the density regions and the color values that are converted based on the print density adjustment amounts at the time with respect to the color sample image SCP that is selected using the sample image selection screen (the image that appears to be most achromatic to the user) become now the print density adjustment amounts that are determined by the print density adjustment operation using the color balance adjustment sheet. Specifically, in the print density adjustment management part 210B, the color values after print density adjustment of the selected color sample images SCP that are selected in the respective density regions of the low density region, the intermediate density region and the high density region are respectively (C, M, Y, K)=(46, 49, 45, 0), (107, 106, 109, 0) and (148, 163, 163, 0). Therefore, the respective print density adjustment amounts of cyan, magenta and yellow in the respective density regions are obtained using the following formulas (49)-(57).

[The print density adjustment amounts of the low density region]

$$\Delta Lc'=46-51=-5 \quad (49)$$

$$\Delta Lm'=49-51=-2 \quad (50)$$

$$\Delta Ly'=45-51=-6 \quad (51)$$

[The print density adjustment amounts of the intermediate density region]

$$\Delta Mc'=107-102=+5 \quad (52)$$

$$\Delta Mm'=106-102=+4 \quad (53)$$

$$\Delta My'=109-102=+7 \quad (54)$$

[The print density adjustment amounts of the high density region]

$$\Delta Hc'=148-153=-5 \quad (55)$$

$$\Delta Hm'=163-153=+10 \quad (56)$$

$$\Delta Hy'=163-153=+10 \quad (57)$$

The print density adjustment amount determination part 303B holds, in the low density region print density adjustment amount holding part 302L, the calculated values of ΔLc', ΔMm' and ΔLy' as new print density adjustment amounts of the low density region. Further, the print density adjustment amount determination part 303B holds, in the intermediate density region print density adjustment amount holding part 302M, the calculated values of ΔMc', ΔMm' and ΔMy' as new print density adjustment amounts of the intermediate density region. Further, the print density adjustment amount determination part 303B holds, in the high density region print density adjustment amount holding part 302H, the calculated values of ΔHc', ΔHm' and ΔHy' as new print density adjustment amounts of the high density region.

Thereafter, when print density fine adjustments are received by using the print density fine adjustment function (the print density fine adjustment screen) (for example, when values as illustrated in FIGS. 24B and 24C are input using the print density fine adjustment screen), the print density adjustment management part 210B can hold the received print density adjustment amounts after the fine adjustments as new print density adjustment amounts. For example, when the user viewing the color balance adjustment sheet judges that the hue of cyan should be little stronger, the hue of cyan can be enhanced by modifying the print density adjustment amount of cyan in the + direction (for example, modifying the adjustment amount of the low density region from −5 to −2, the adjustment amount of the intermediate density region from +5 to +8, and the adjustment amount of the high density region from −5 to −2 (see FIG. 24C).

(C-2) Operation of Third Embodiment

Next, an operation of the printer 1B of the third embodiment having the above configuration is described.

In the following, with respect to the operation of the printer 1B of the third embodiment, differences as compared to the first embodiment are mainly described.

In the operation of the printer 1B of the third embodiment, an operation of the image signal converter 207B when printing is performed and an operation of the print density adjustment management part 210B when print density adjustment is performed are different from the first embodiment.

Figure 25:
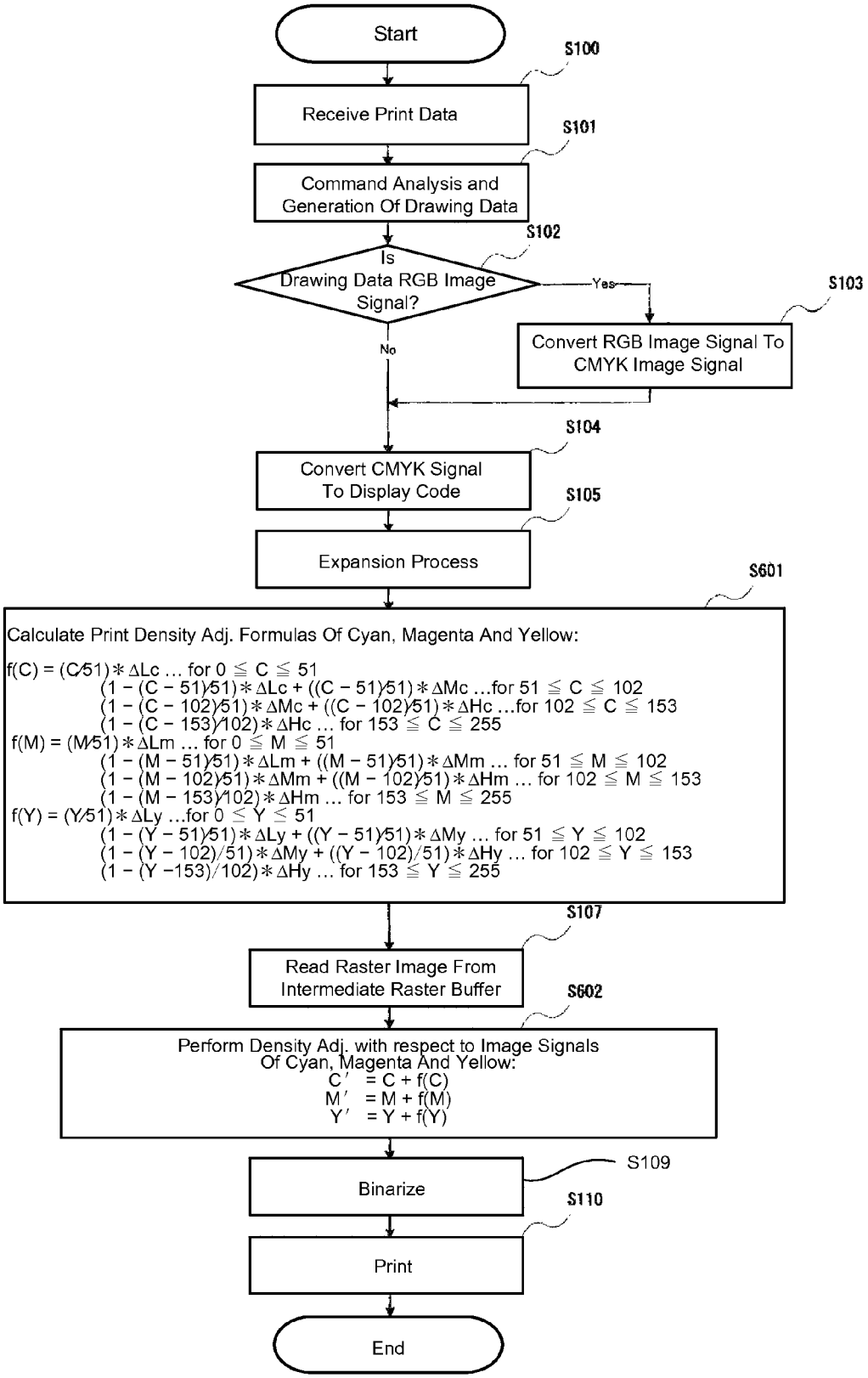
FIG. 25 illustrates a flow diagram illustrating operations when printing is performed in the printer according to the third embodiment.

First, an operation when printing is performed in the printer 1B is described using the flow diagram of FIG. 25. In FIG. 25, an operation that is the same as in the above-described FIG. 11 is indicated using the same step number (reference numeral symbol).

The printer 1B of the third embodiment is different in that the processes of S106 and S108 are replaced by processes of S601 and S602 (to be described later).

At S601, based on the print density adjustment amounts that are held in the low density region print density adjustment amount holding part 302L, the intermediate density region print density adjustment amount holding part 302M and the high density region print density adjustment amount holding part 302H, the image signal converter 207B obtains print density adjustment formulas (formulas for calculating print density adjustment amounts with respect to input color values) for the low density region, the intermediate density region and the high density region. Specifically, the image signal converter 207B obtains necessary print density adjustment formulas by applying the print density adjustment amounts ($\Delta Lc$, $\Delta Lm$, $\Delta Ly$) of the low density region, the print density adjustment amounts ($\Delta Mc$, $\Delta Mm$, $\Delta My$) of the intermediate density region and the print density adjustment amounts ($\Delta Hc$, $\Delta Hm$, $\Delta Hy$) of the high density region to the above formulas (16)-(27).

Further, at S602, the image signal converter 207B performs print density adjustment using the print density adjustment formulas obtained at the above-described S601 (for example, print density adjustment using formulas similar to the above formulas (40)-(48)) with respect to color image signals (image signals of cyan, magenta and yellow) among image signals of a raster image of CMYK image signals that are read from the intermediate raster buffer 206.

Figure 26:
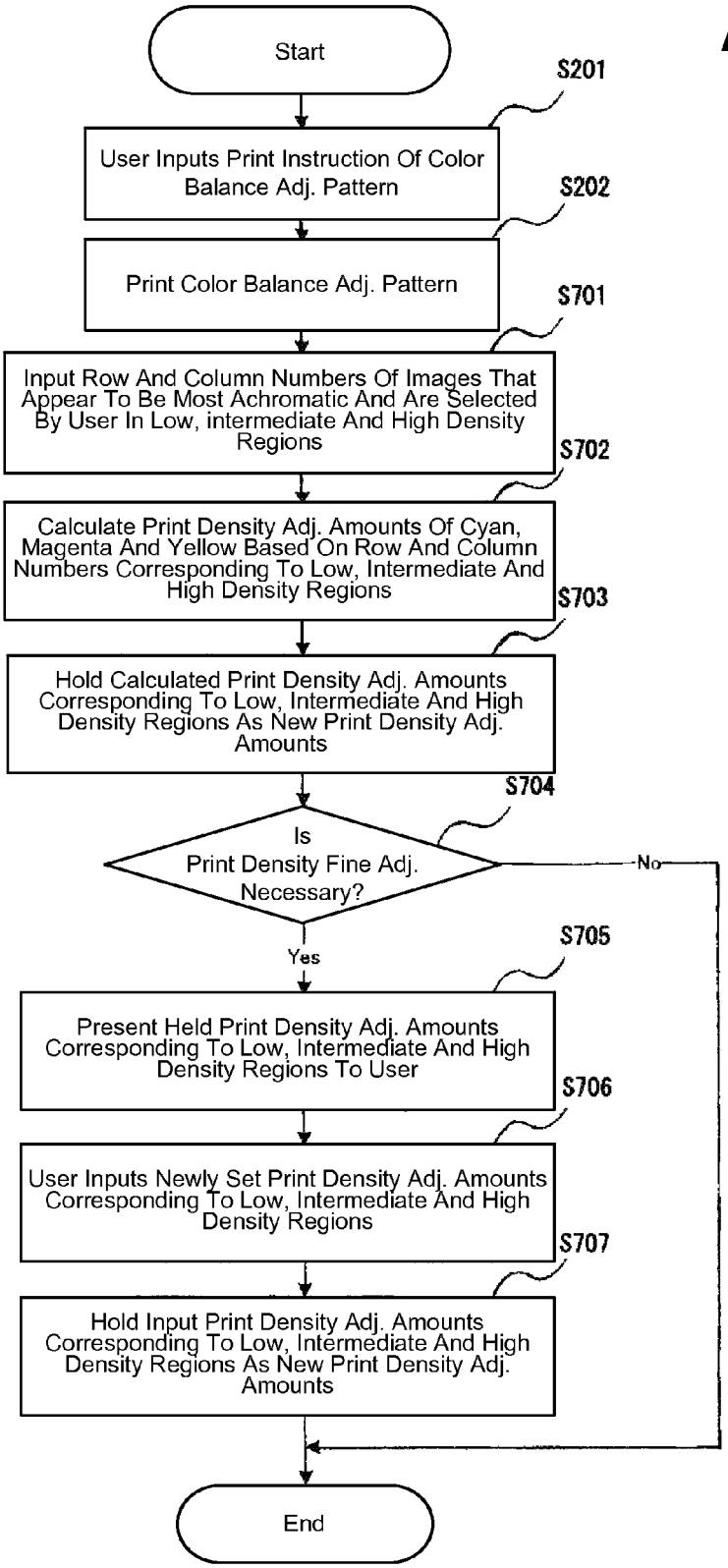
FIG. 26 illustrates a flow diagram illustrating operations when print density adjustment is performed in the printer according to the third embodiment.

Next, a density adjustment process that the print density adjustment management part 210B performs is described using the flow diagram of FIG. 26. In FIG. 26, an operation that is the same as in the above-described FIG. 12 is indicated using the same step number (reference numeral symbol).

First, in response to an operation of the user (operation with respect to the operation panel 209), the color balance adjustment pattern is printed by the printer 1B (print density adjustment management part 210B) (S201, S202). A print process flow of the color balance adjustment pattern in the printer 1B is the same as that with respect to the print data that is received from outside in the above-described FIG. 25 and thus a detailed description thereof is omitted.

Next, the print density adjustment management part 210B displays the sample image selection screen on the display 209*a* of the operation panel 209. The print density adjustment management part 210B receives from the user an input of an image number of the corresponding color sample image SCP (image number of an image that is selected by the user viewing the color balance adjustment sheet and that appears to be most achromatic) for each of the low density region, the intermediate density region and the high density region (S701).

Next, based on the image numbers that are input at S701, the print density adjustment management part 210B calculates the respective print density adjustment amounts (print density adjustment amounts of cyan, magenta and yellow) of the low density region, the intermediate density region and the high density region (S702), and holds the respective print density adjustment amounts in the corresponding print density adjustment amount holding parts (the low density region print density adjustment amount holding part 302L, the intermediate density region print density adjustment amount holding part 302M and the high density region print density adjustment amount holding part 302H) (S703).

Next, the print density adjustment management part 210B receives from the user an input of whether or not fine adjustment is necessary with respect to the print density adjustment amounts (S704). The process of S704 is the same as the process of the first embodiment (the process of the above-described S206) an thus a detailed description thereof is omitted.

At the above-described S704, when an input indicating that fine adjustment with respect to the print density adjustment amounts is not necessary is received, the process of the print density adjustment ends.

Further, when an input indicating that fine adjustment with respect to the print density adjustment amounts is necessary is received from the user, the print density adjustment management part 210B operates from a process of S705 (to be described later), and performs the print density fine adjustment. Specifically, the print density adjustment amount fine adjusting part 305B displays the print density fine adjustment screen, and further displays the values of the print density adjustment amounts that are stored in the corresponding print density adjustment amount holding parts (the low density region print density adjustment amount holding part 302L, the intermediate density region print density adjustment amount holding part 302M and the high density region print density adjustment amount holding part 302H) in the respective fields of the low density region, the intermediate density region and the high density region (fields of the respective values of cyan, magenta and yellow of the respective density regions) of the print density fine adjustment screen (S705).

The print density adjustment amount fine adjusting part 305B receives fine adjustments (update inputs) with respect to the print density adjustment amounts of the low density region, the intermediate density region and the high density region (print density adjustment amounts of cyan, magenta and yellow of the respective density regions) using the print density fine adjustment screen (S706).

Next, the print density adjustment amount fine adjusting part 305B calculates the print density adjustment amounts based on the input values, and holds the print density adjustment amounts in the corresponding print density adjustment amount holding parts (the low density region print density adjustment amount holding part 302L, the intermediate density region print density adjustment amount holding part 302M and the high density region print density adjustment amount holding part 302H) (S707). As a result, the print density adjustment process by the print density adjustment management part 210B ends.

Thereafter, when print data received from outside is printed in the printer 1B, in the image signal converter 207B, the print density adjustment amounts that are held at S703 or S707 are referenced.

Figure 27:
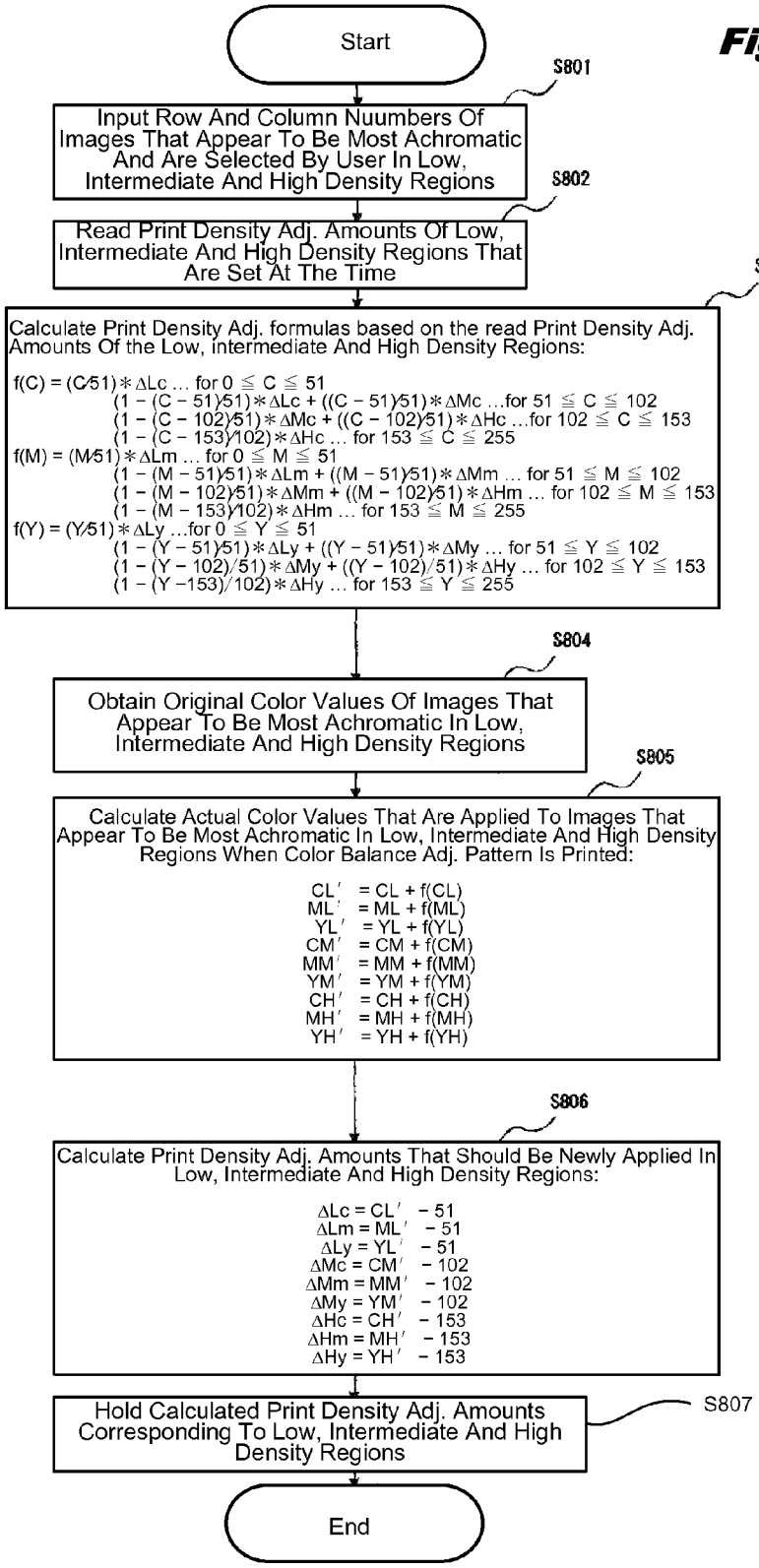
FIG. 27 illustrates a flow diagram illustrating operations of the print density adjustment management part of the third embodiment.

Next, details of a calculation process of the print density adjustment amounts in the print density adjustment management part 210B (a process of the above-described S702) are described using the flow diagram of FIG. 27.

First, the print density adjustment amount determination part 303B obtains the image numbers for the low density region, the intermediate density region and the high density region that are input (selected) by the user on the sample image selection screen of the above-described S701 (S801).

Next, the print density adjustment amount determination part 303B reads, from the print density adjustment amount holding part 302, the print density adjustment amounts (the respective print density adjustment amounts of cyan, magenta and yellow) that are set at the time in the respective print density adjustment amount holding parts (the low density region print density adjustment amount holding part 302L, the intermediate density region print density adjustment amount holding part 302M and the high density region print density adjustment amount holding part 302H) (S802).

Next, based on the print density adjustment amounts that are read at the above-described S802, the print density adjustment amount determination part 303B obtains print density adjustment formulas for the low density region, the intermediate density region and the high density region (S803). Specifically, the print density adjustment amount determination part 303B obtains necessary print density adjustment formulas by applying the print density adjustment amounts (ΔLc, ΔLm, ΔLy) of the low density region, the print density adjustment amounts (ΔMc, ΔMm, ΔMy) of the intermediate density region and the print density adjustment amounts (ΔHc, ΔHm, ΔHy) of the high density region to the above-described formulas (16)-(27). Next, based on the image numbers that are obtained at the above-described S801 and the color values that are set to the color balance adjustment pattern of the color balance adjustment pattern storing part 301, the print density adjustment amount determination part 303B obtains the original color values (color values before the density adjustment) of the color sample images SCP that are selected by the user at the above-described S701 (the color sample images SCP for the low density region, the intermediate density region and the high density region that are selected by the user as images that appear to be most achromatic) (S804).

Next, based on the print density adjustment formula calculated at the above-described S803, the print density adjustment amount determination part 303B calculates, using the following formulas (58)-(66) and with respect to the original color values obtained at S804, the actual color values that are applied to the color sample images SCP that are selected by the user (the color sample images SCP of the low density region, the intermediate density region and the high density region that are selected by the user as images that appear to be most achromatic) when the color balance adjustment pattern is printed (S805).

In the following formulas (58)-(66), CL, ML and YL respectively indicate the original color values of the color sample image SCP that is selected by the user in the low density region. CL', ML' and YL' respectively indicate the actual color values that are applied to the color sample image SCP that is selected by the user in the low density region when the color balance adjustment pattern is printed. Further, CM, MM and YM respectively indicate the original color values of the color sample image SCP that is selected by the user in the intermediate density region. CM', MM' and YM' respectively indicate the actual color values that are applied to the color sample image SCP that is selected by the user in the intermediate density region when the color balance adjustment pattern is printed. Further, CH, MH and YH respectively indicate the original color values of the color sample image SCP that is selected by the user in the high density region. CH', MH' and YH' respectively indicate the actual color values that are applied to the color sample image SCP that is selected by the user in the high density region when the color balance adjustment pattern is printed.

$$CL'=CL+f(CL) \tag{58}$$

$$ML'=ML+f(ML) \tag{59}$$

$$YL'=YL+f(YL) \tag{60}$$

$$CM'=CM+f(CM) \tag{61}$$

$$MM'=MM+f(MM) \tag{62}$$

$$YM'=YM+f(YM) \tag{63}$$

$$CH'=CH+f(CH) \tag{64}$$

$$MH'=MH+f(MH) \tag{65}$$

$$YH'=YH+f(YH) \tag{66}$$

Next, the print density adjustment amount determination part 303B calculates the print density adjustment amounts that should be newly applied corresponding to the low density region, the intermediate density region and the high density region by subtracting the color values of the reference images BCP of the respective density regions from the actual color values that are calculated at S805 and that are applied to the color sample images SCP that are selected by the user for the respective regions of the low density region, the intermediate density region and the high density region (S806). Specifically, the print density adjustment amount determination part 303B calculates the print density adjustment amounts that should be newly applied by using the following formulas (67)-(75).

In the following formulas (67)-(75), 51, 102 and 153 respectively indicate color values (color values of the reference images BCP) that are references for the print density adjustment in the low density region, the intermediate density region and the high density region.

$$\Delta Lc=CL'-51 \tag{67}$$

$$\Delta Lm=ML'-51 \tag{68}$$

$$\Delta Ly=YL'-51 \tag{69}$$

$$\Delta Mc=CM'-102 \tag{70}$$

$$\Delta Mm=MM'-102 \tag{71}$$

$$\Delta My=YM'-102 \tag{72}$$

$$\Delta Hc=CH'-153 \tag{73}$$

$$\Delta Hm=MH'-153 \tag{74}$$

$$\Delta Hy=YH'-153 \tag{75}$$

Finally, the print density adjustment amount determination part 303B holds, in the respective print density adjustment amount holding parts (the low density region print density adjustment amount holding part 302L, the intermediate density region print density adjustment amount holding part 302M and the high density region print density adjustment amount holding part 302H), the print density adjustment amounts of the low density region, the intermediate density region and the high density region that are calculated at the above-described S806 and that should be newly applied (S807).

(C-3) Effects of Third Embodiment

According to the third embodiment, the following effects can be achieved.

In the printer 1B of the third embodiment, a configuration in which optimal density adjustment is performed for each of the print density regions of the three levels (the low density region, the intermediate density region and the high density region). Therefore, in addition to the effects of the first embodiment, it is possible to provide a gray balance adjustment function of a higher accuracy.

(D) Fourth Embodiment

In the following, with reference to the drawings, a fourth embodiment is described in which the image forming apparatus and the control program according to the present invention are applied to a printer.

(D-1) Configuration of Fourth Embodiment

A hardware configuration and an overall functional configuration of a printer 1C of the fourth embodiment can be described using the same drawings (FIGS. 1-4) as the third embodiment. In the following, with respect to the fourth embodiment, only differences as compared to the third embodiment are described.

The printer 1C of the fourth embodiment is different from the third embodiment in that the image signal converter 207B and the print density adjustment management part 210B are replaced by an image signal converter 207C and a print density adjustment management part 210C.

Figure 28:
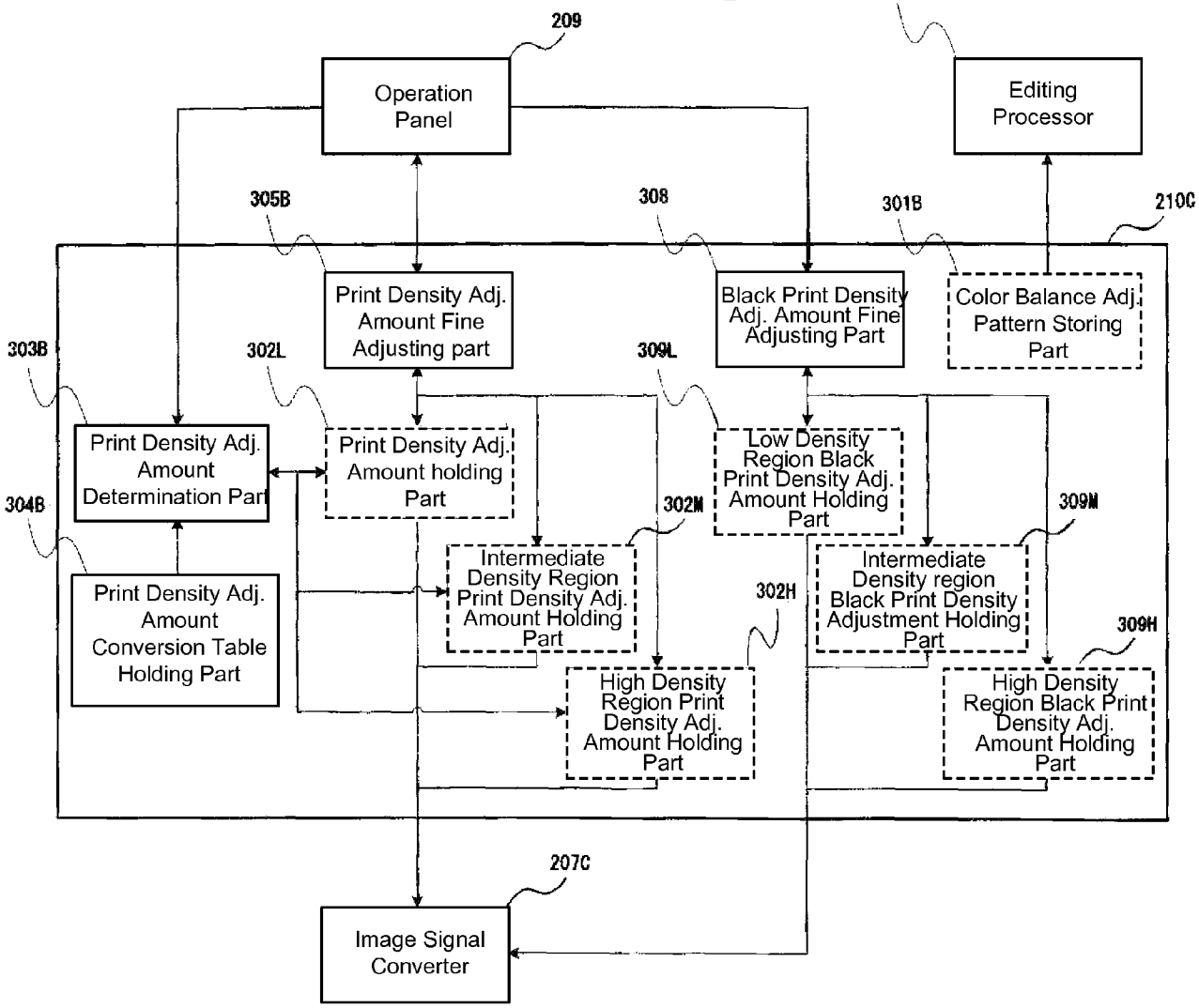
FIG. 28 illustrates a block diagram illustrating a functional configuration of a print density adjustment management part that configures a printer according to a fourth embodiment.

A functional configuration of the print density adjustment management part 210C of the fourth embodiment is described using FIG. 28.

FIG. 28 illustrates a functional configuration of the print density adjustment management part 210C of the fourth embodiment. In FIG. 28, a part that is the same as or corresponding to a part in the above-described FIG. 19 is indicated using the same or corresponding reference numeral symbol.

The print density adjustment management part 210B of the fourth embodiment is different from the third embodiment in that, not only density adjustment for color (CMY) toner agents is performed, but density adjustment for black (K) toner agent alone is also performed using parameters corresponding to the print density regions of a plurality of levels (in this embodiment, three levels including the low density region, the intermediate density region and the high density region).

As illustrated in FIG. 28, the print density adjustment management part 210C of the fourth embodiment is different from the third embodiment in that a black print density adjustment amount fine adjusting part 308 that performs a process to adjust black (K) print density and black print density adjustment amount holding parts (a low density region black print density adjustment amount holding part 309L, an intermediate density region black print density adjustment amount holding part 309M and a high density region black print density adjustment amount holding part 309H) that hold black print density adjustment amounts for the respective density regions are added.

The image signal converter 207C reads a raster image of one page from the intermediate raster buffer 206, converts 8-bit image signal values of the respective CMYK colors into 1-bit image signal values of the respective CMYK colors that are printable by the printer engine 100, and stores the raster image after the conversion in the raster buffer 208. However, when the image signal converter 207C reads the 8-bit image signal values of the respective CMYK colors, the image signal converter 207C inputs the print density adjustment amounts of the respective cyan, magenta, yellow and black colors that are stored in the print density adjustment management part 210C, and converts the image signal values of C, M, Y and K based on the print density adjustment amounts.

The print density adjustment management part 210C of this embodiment holds, as black print density adjustment amounts of respective density regions, increase or decrease amounts with respect to color values of the target images TP that are arranged in the color balance adjustment pattern, represented with a black monochromatic color, and correspond to the respective density regions. Specifically, in the print density adjustment management part 210C, the black print density adjustments are held by the low density region black print density adjustment amount holding part 309L, the intermediate density region black print density adjustment amount holding part 309M and the high density region black print density adjustment amount holding part 309H. The low density region black print density adjustment amount holding part 309L holds the black print density adjustment amount of the low density region. Further, the intermediate density region black print density adjustment amount holding part 309M holds the black print density adjustment amount of the intermediate density region. Further, the high density region black print density adjustment amount holding part 309H holds the black print density adjustment amount of the high density region. In the following, the black print density adjustment amounts of the low density region, the intermediate density region and the high density region are respectively represented using ΔLk, ΔMk and ΔHk.

In response to an operation of the user, the black print density adjustment amount fine adjusting part 308 receives adjustments (updates) with respect to the black print density adjustment amounts that are held in the black print density adjustment amount holding parts of the respective density regions (the low density region black print density adjustment amount holding part 309L, the intermediate density region black print density adjustment amount holding part 309M, and the high density region black print density adjustment amount holding part 309H). Specifically, the black print density adjustment amount fine adjusting part 308 displays the black print density adjustment amounts held by the black print density adjustment amount holding parts of the respective density regions at the time, and displays, on the operation panel 209 (display 209*a*). a black print density adjustment screen that allows the black print density adjustment amounts to be adjusted. As the black print density adjustment screen, for example, as illustrated in FIGS. 29, 30A and 30B, a screen can be applied in which the black print density adjustment amounts of the respective density regions are displayed and fields that allow the displayed black print density adjustment amounts to be modified (allow the values to be modified) are arranged. Further, FIG. 30A illustrates a state in which the black print density adjustment amounts that are held in the black print density adjustment amount holding parts of the respective density regions are respectively ΔLk=0, ΔMk=0 and ΔHk=0. Further, FIG. 30B illustrates a state in which the black print density adjustment amounts that are held in the black print density adjustment amount holding parts of the respective density regions are respectively is ΔLk=−5, ΔMk=+5 and ΔHk=−5.

The black print density adjustment amount fine adjusting part 308 holds the black print density adjustment amounts of the respective density regions that are input using the black print density adjustment screen in the black print density adjustment amount holding parts of the respective density regions. Next, an adjustment method of the black print density when the printer 1C (the print density adjustment management part 210C) prints print data that contains the color balance adjustment pattern is described.

In the black print density adjustment in the image signal converter 207C, similar to cyan, magenta and yellow, calculation of the adjustment amounts is performed using interpolation calculation in which the respective print density adjustment amounts and input color values for the low density region, the intermediate density region and the high density region are used as coefficients. Therefore, in the image signal converter 207C, based on the black print density adjustment amounts that correspond to the respective density regions and that are set the time, print density adjustment formulas that are applied to the print density adjustment are calculated.

When a color value of black of each pixel that is input to the image signal converter 207C is K, print density adjustment formulas for obtaining print density adjustment amount f(K) that is applied to K in the image signal converter 207C can be expressed, for example, by the following formulas (76)-(79). In the following formulas (76)-(79), "64", "128" and "192" are black color values that are respectively set to the target image TP of the low density region, the target image TP of the intermediate density region and the target image TP of the high density region.

[For 0≤K≤64]

$$f(K)=(K/64)*\Delta Lk \quad (76)$$

[For 64≤K≤128]

$$f(K)=(1-(K-64)/64)*\Delta Lk+((K-64)/64)*\Delta Mk \quad (77)$$

[For 128≤K≤192]

$$f(K)=(1-(K-128)/64)*\Delta Mk+((K-128)/64)*\Delta Hk \quad (78)$$

[For 192≤K≤255]

$$f(K)=(1-(K-192)/63)*\Delta Hk \quad (79)$$

For example, when the black print density adjustment amount held in the low density region black print density adjustment amount holding part 309L is ΔLk=−5, the black print density adjustment amount held in the intermediate density region black print density adjustment amount holding part 309M is ΔMk=+5 and the black print density adjustment amount held in the high density region black print density adjustment amount holding part 309H is ΔHk=−5, color values of an image that is printed in the printer 1C at the time are calculated in the image signal converter 207C using one of the following formulas (80)-(83).

[For 0≤K≤64]

$$K'=K+(K/64)*(-5) \quad (80)$$

[For 64≤K≤128]

$$K'=K+(1-(K-64)/64)*(-5)+((K-64)/64)*(+5) \quad (81)$$

[For 128≤K≤192]

$$K'=K+(1-(K-128)/64)*(+5)+((K-128)/64)*(-5) \quad (82)$$

[For 192≤K≤255]

$$K'=K+(1-(K-192)/63)*(-5) \quad (83)$$

Specifically, in a situation where ΔLk=−5, ΔMk=+5 and ΔHk=−5 are set, when the color balance adjustment pattern is printed, color values of the target images TP corresponding to the respective density regions that are actually printed can be obtained, for example, using the following formulas (84)-(86). In the following formulas (84)-(86), KL', KM' and KH' are respectively color values when the target images TP corresponding to the low density region, the intermediate density region and the high density region are actually printed (as the color balance adjustment sheet).

[Color values of the low density region]

$$KL'=64+(64/64)*(-5)=59 \quad (84)$$

[Color values of the intermediate density region]

$$KM'=128+(1-(128-64)/64)*(-5)+((128-64)/64)*(+5)=133 \quad (85)$$

[Color values of the high density region]

$$KH'=192+(1-(192-128)/64)*(+5)+((192-128)/64)*(-5)=187 \quad (86)$$

In the printer 1C, in the above-described state (the state in which ΔLk=−5, ΔMk=+5 and ΔHk=−5 are set), when the color balance adjustment sheet is output, a state is reproduced in which the target images TP of the color balance adjustment sheet are lighter than the standard in the low density region, darker than the standard in the intermediate density region, and lighter than the standard in the high density region. Therefore, as a result, the color values of cyan, magenta and yellow of the color sample images SCP that are selected at the time are increased or decreased according to the density of black as compared to the case of standard (the case where ΔLk=ΔMk=ΔHk=0). That is, the respective print density adjustment amounts of cyan, magenta and yellow are set to values in directions lighter than the case of standard in the low density region, in directions darker than the case of standard in the intermediate density region, and in directions lighter than the case of standard in the high density region. On the other hand, when ΔLk is set to a value in a plus direction, ΔMk is set to a value in a minus direction and ΔHk is set to a value in a plus direction, the respective print density adjustment amounts of cyan, magenta and yellow are set to values in directions darker than the case of standard in the low density region, in directions lighter than the case of standard in the intermediate density region, and in directions darker than the case of standard in the high density region.

(D-2) Operation of Fourth Embodiment

Next, an operation of the printer 1C of the fourth embodiment having the above configuration is described.

In the following, with respect to the operation of the printer 1C of the fourth embodiment, differences as compared to the third embodiment are mainly described.

In the operation of the printer 1C of the fourth embodiment, an operation of the image signal converter 207C when printing is performed and an operation of the print density adjustment management part 210C when print density adjustment is performed are different from the third embodiment.

Figure 31:
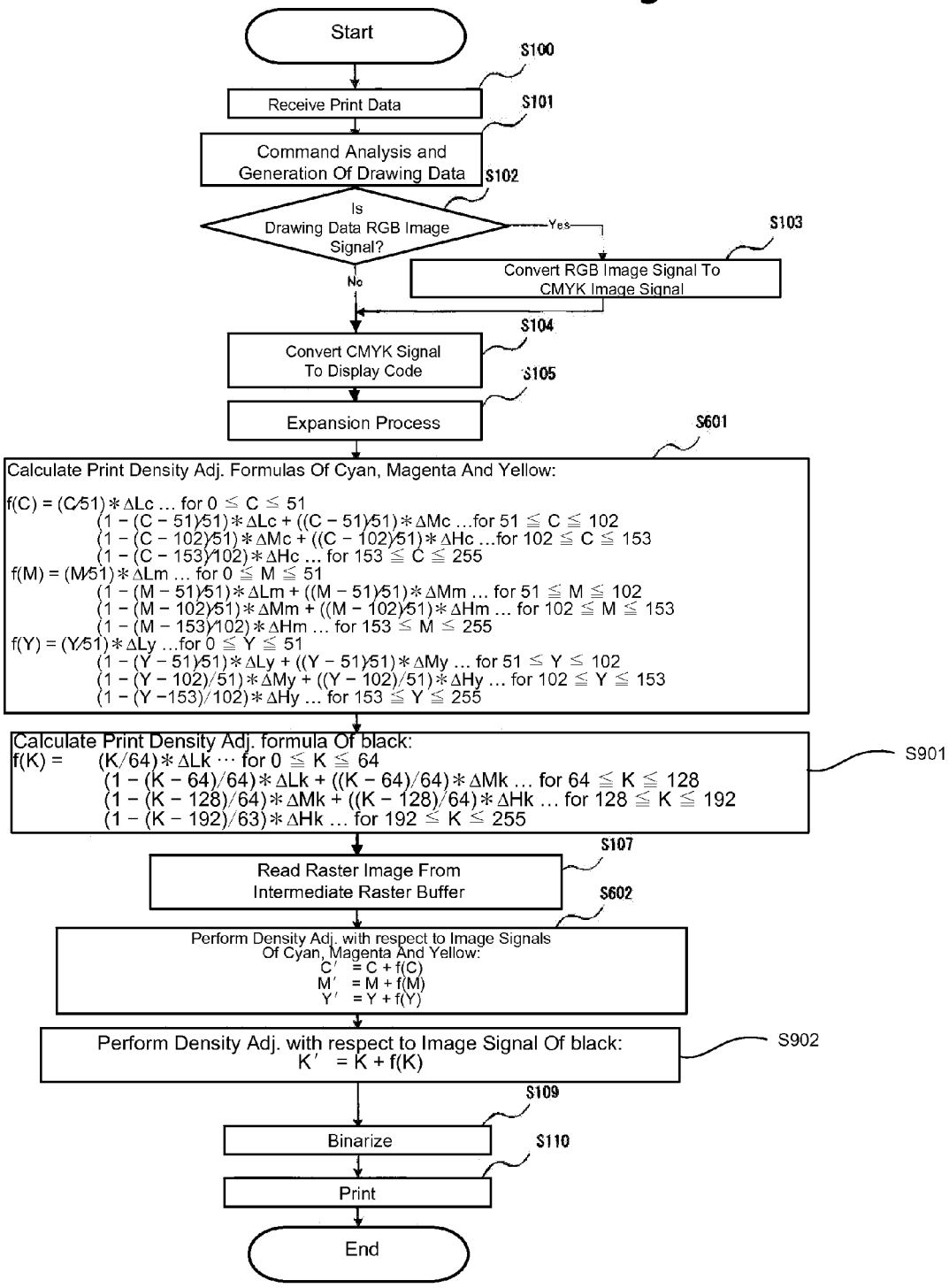
FIG. 31 illustrates a flow diagram illustrating operations when printing is performed in the printer according to the fourth embodiment.

First, an operation when printing is performed in the printer 1C is described using the flow diagram of FIG. 31. In FIG. 31, an operation that is the same as in the above-described FIG. 25 is indicated using the same step number (reference numeral symbol).

In the printer 1C of the fourth embodiment, the operation when printing is performed is different in that processes of S901 and S902 are added. The image signal converter 207C of the fourth embodiment is different from the third embodiment in that, when the print density adjustment formulas of cyan, magenta and yellow are obtained by the process of the above-described S601, the print density adjustment formula of black is also obtained at S901 (for example, using the above formulas (76)-(79)).

Further, image signal converter 207C of the fourth embodiment is different from the third embodiment in that, when density adjustment is performed with respect to image signals of cyan, magenta and yellow by the process of the above-described S602, density adjustment with respect to an image signal of black is performed by a process of S902 (for example, density adjustment is performed using the following formula (87)).

$$K'=K+f(K) \quad (87)$$

Figure 32:
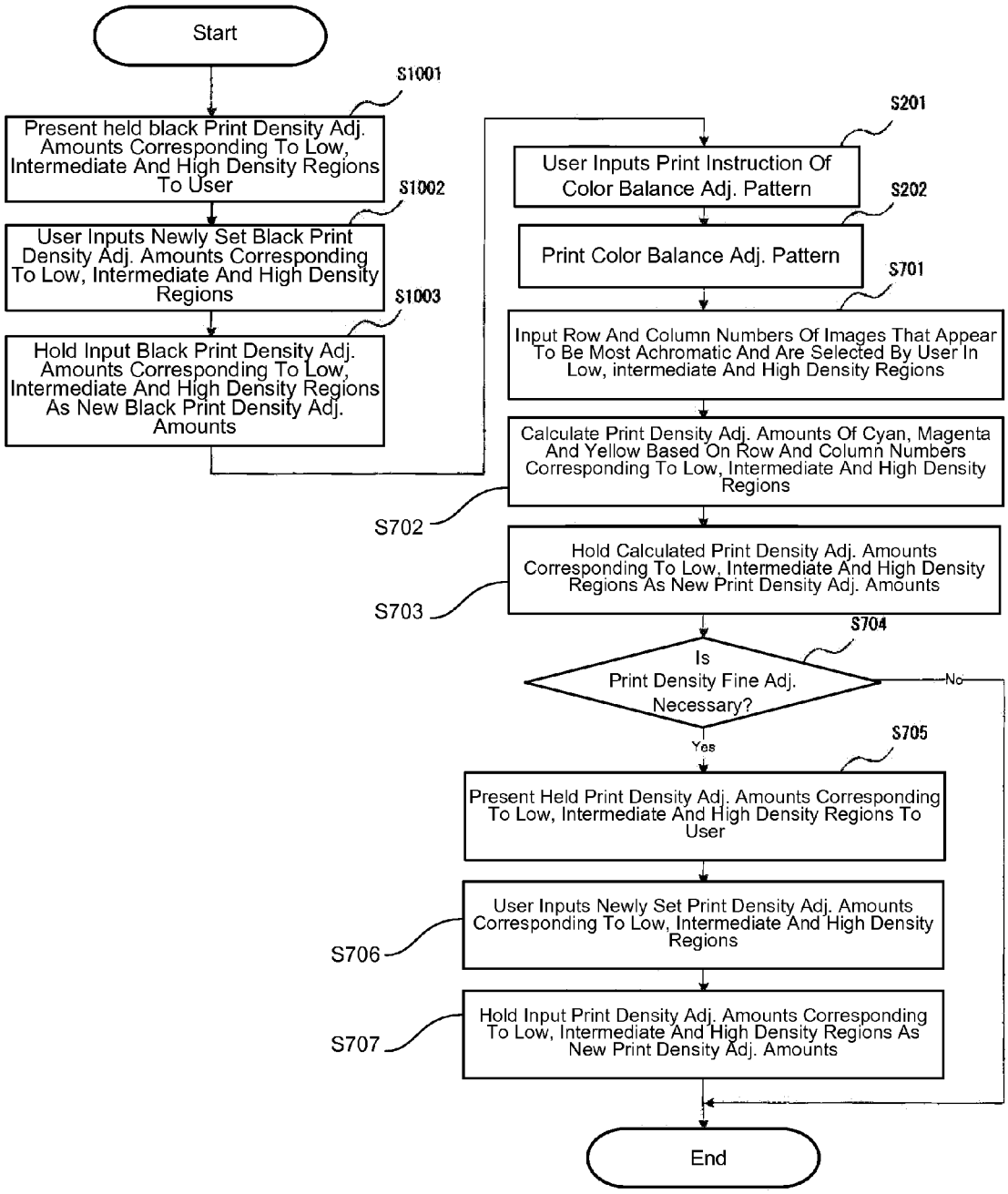
FIG. 32 illustrates a flow diagram illustrating operations when print density adjustment is performed in the printer according to the fourth embodiment.

Next, a density adjustment process that the print density adjustment management part 210C performs is described using the flow diagram of FIG. 32. In FIG. 32, an operation that is the same as in the above-described FIG. 26 is indicated using the same step number (reference numeral symbol).

The print density adjustment management part 210C of the fourth embodiment is different from the third embodiment in that a black print density adjustment process (process of S1001-S1003) is added. In FIG. 32, the process of S1001-S1003 is arranged at beginning of the flow diagram (at a timing prior to S201).

When the black print density adjustment process is started, the print density adjustment management part 210C (black print density adjustment amount fine adjusting part 308) first displays a black print density adjustment screen on the operation panel 209 (display 209*a*) (S1001) to present to the user the black print density adjustment amounts of the respective density regions that are held by the black print density adjustment amount holding parts of the respective density regions (the low density region black print density adjustment amount holding part 309L, the intermediate density region black print density adjustment amount holding part 309M and the high density region black print density adjustment amount holding part 309H), and receives updates with respect to the black print density adjustment amounts of the respective density regions (S1002). For example, when the black print density adjustment amounts of the respective density regions that are initially held by the black print density adjustment amount holding parts of the respective density regions (the low density region black print density adjustment amount holding part 309L, the intermediate density region black print density adjustment amount holding part 309M and the high density region black print density adjustment amount holding part 309H) are respectively $\Delta Lk=0$, $\Delta Mk=0$ and $\Delta Hk=0$, an initial state of the black print density adjustment screen is as illustrated in FIG. 30A. When the black print density adjustment amounts of the respective density regions are respectively updated by the user to be $\Delta Lk=-5$, $\Delta Mk=+5$ and $\Delta Hk=-5$, the state of the black print density adjustment screen becomes as illustrated in FIG. 30B.

When the values of the black print density adjustment amounts of the respective density regions are modified using the black print density adjustment screen, the black print density adjustment amount fine adjusting part 308 holds the values in the black print density adjustment amount holding parts of the respective density regions (the low density region black print density adjustment amount holding part 309L, the intermediate density region black print density adjustment amount holding part 309M and the high density region black print density adjustment amount holding part 309H) (S1003).

Thereafter, when print data received from outside is printed in the printer 1C, in the image signal converter 207C, the black print density adjustment amounts of the respective density regions that are held at S1003 are referenced.

(D-3) Effects of Fourth Embodiment

According to the fourth embodiment, the following effects can be achieved.

In the printer 1C of the fourth embodiment, the configuration in which the black print density when printing is performed is adjusted in the print density regions of the plurality of levels (the low density region, the intermediate density region and the high density region) and the step to adjust the black print density adjustment amounts before the print density adjustment operation using the color balance adjustment sheet that is described in the third embodiment are added. Therefore, when performing the print density adjustment operation using the color balance adjustment sheet, the darkness of the black monochromatic color that forms the target images can be modified for each of the print density regions. That is, in the printer 1C of the fourth embodiment, by adjusting the black print density adjustment amount for each of the print density regions before performing the print density adjustment operation using the color balance adjustment sheet, when the print density adjustment operation using the color balance adjustment sheet is performed, densities of cyan, magenta and yellow corresponding to each of the print density regions can be automatically adjusted in directions darker or lighter than the standards without explicit specification from the user and a color balance that matches user's intention can be realized.

(E) Other Embodiments

The present invention is not limited to the above embodiments, but modified embodiments as illustrated in the following are also possible.

(E-1) In the above embodiments, the image forming apparatus of the present invention is described using an electrophotographic color printer as an example. However, the present invention is also applicable to other image forming apparatuses. For example, the image forming apparatus of the present invention may also be applied to a printer other than that of an electrophotographic type and further to an apparatus such as a multifunction machine or a copy machine that performs image formation by inputting scanned image data instead of the print data (an apparatus having a mechanism in which an image is formed by inputting print data from outside).

(E-2) In the above embodiments, an example is described in which a controller (for example, a computer in which the control program of the present invention is installed) is mounted on the printer itself. However, it is also possible that a function same as the controller is constructed as another device (for example, as a printer server) to perform a linked operation.

What is claimed is:

1. An image forming apparatus comprising:

an image forming part forming an image on a medium using a developer of black and developers of a plurality of colors different from black;

a sample pattern outputting part holding a sample pattern and supplying the held sample pattern to the image forming part to form an image on a medium to be output as a sample, the sample pattern including a reference image, a plurality of color sample images and a target image, the reference image and the plurality of color sample images being formed by the developers of the plurality of colors, the target image being formed by the developer of black, the reference image being expressed by the plurality of the colors of respective predetermined densities, the plurality of the color sample images being expressed by modifying the predetermined density of each of the plurality of the colors that are used to express the reference image by a predetermined amount;

a designation part allowing a user to designate one of the color sample images that configure the sample pattern;

a first holding part determining and holding color density adjustment amounts that are used when the image forming part performs image formation using the developers of the plurality of colors, according to the color sample image that is designated by the user;

an adjusting part adjusting color densities that are used when the image forming part performs the image formation using the developers for the plurality of colors, according to the color density adjustment amounts held by the first holding part;

a presenting part presenting to the user the color density adjustment amounts that are held by the first holding part;

a modifying part receiving from the user modifications with respect to the color density adjustment amounts that are presented by the presenting part and updating the color density adjustment amounts that are held by the first holding part to color density adjustment amounts after the modification; and a second holding part holding a black density adjustment amount that is used when the image forming part performs image formation using the developer of black, wherein the presenting part presents to the user the black density adjustment amount that is held by the second holding part, the modifying part receives from the user a modification with respect to the black density adjustment amount that is presented by the presented part and updates the black density adjustment amount that is held by the second holding part to a black density adjustment amount after the modification, and the adjusting part adjusts a black density that is used when the image forming part performs the image formation of the target image using the developer of black, according to the updated black density adjustment amount.

2. The image forming apparatus according to claim 1, wherein the plurality of colors are three colors of cyan, magenta and yellow.

3. The image forming apparatus according to claim 1, wherein the sample pattern is one of a plurality of sample patterns, the sample pattern outputting part holds the plurality of sample patterns each of which corresponds to one of a plurality of density regions, and supplies the held plurality of the sample patterns to the image forming part, the designation part allows the user to designate one of the color sample images from each of the plurality of sample patterns, the first holding part determines and holds the color density adjustment amounts for each of the plurality of density regions, according to the color sample images that are designated by the user, the adjusting part adjust the color densities for each of the plurality of density regions that are used when the image forming part performs the image formation using the developers of the plurality of colors, according to the color density adjusting amounts that are held by the first holding part, the presenting part presents to the user the color density adjustment amount for each of the plurality of density regions, and the modifying part receives from the user modifications with respect to the color density adjustment amounts for each of the plurality of density regions that are presented by the presenting part, and updates the color density adjustment amounts to color density adjustment amounts after the modification.

4. The image forming apparatus according to claim 3, wherein the second holding part holds, a plurality of the black density adjustment amounts each of which corresponds to one of the plurality of density regions, the presenting part presents to the user the black density adjustment amounts each of which corresponds to one of the plurality of density regions, the modifying part receives from the user modifications with respect to the black density adjustment amounts that are presented by the presenting part, and updates the black density adjustment amounts to black density adjustment amounts after the modification, and the adjusting part adjusts the black density that is used when the image forming part performs the image formation of the target image for each of the plurality of density regions using the developer of black, according to the updated black density adjustment amount for each of the plurality of density regions.

5. A control program controlling an image forming apparatus that has an image forming part that forms an image on a medium using a developer of black and developers of a plurality of colors different from black, the control program causing a computer to function as:

a sample pattern outputting part holding a sample pattern and supplying the held sample pattern to the image forming part to form an image on a medium to be output as a sample, the sample pattern including a reference image, a plurality of color sample images and a target image, the reference image and the plurality of color sample images being formed by the developers of the plurality of colors, the target image being formed by the developer of black, the reference image being expressed by the plurality of the colors of respective predetermined densities, the plurality of the color sample images being expressed by modifying the predetermined density of each of the plurality of the colors that are used to express the reference image by a predetermined amount;

a designation part allowing a user to designate one of the color sample images that configure the sample pattern;

a first holding part determining and holding color adjustment amounts that are used when the image forming part performs image formation using the developers of the plurality of colors, according to the color sample image that is designated by the user;

an adjusting part adjusting color densities that are used when the image forming part performs the image formation using the developers of the plurality of colors, according to the color density adjustment amounts held by the first holding part;

a presenting part presenting to the user the color density adjustment amounts that are held by the first holding part;

a modifying part receiving from the user modifications with respect to the color density adjustment amounts that are presented by the presenting part and updating the color density adjustment amounts that are held by the first holding part to color density adjustment amounts after the modification; and a second holding part holding a black density adjusting amount that is used when the image forming part performs image formation using the developer of black, wherein the presenting part presents to the user the black density adjustment amount that is held by the second holding part, the modifying part receives from the user a modification with respect to the black density adjustment amount that is presented by the presenting part and updates the black density adjustment amount that is held by the second holding part to a black density adjustment amount after the modification, and the adjusting part adjusts a black density that is used when the image forming part performs the image formation of the target image using the developer of black, according to the updated black density adjustment amount.

6. The image forming apparatus according to claim 1, wherein the target image is an image that becomes an indicator when the user designates one of the color sample images at the designation part.

* * * * *